US006547749B2

(12) United States Patent
Hansen

(10) Patent No.: US 6,547,749 B2
(45) Date of Patent: Apr. 15, 2003

(54) BODY PULSATING METHOD AND APPARATUS

(75) Inventor: Craig N. Hansen, Plymouth, MN (US)

(73) Assignee: Electromed, Inc., New Praque, MN (US)

( * ) Notice: Subject to any disclaimer, the term of this patent is extended or adjusted under 35 U.S.C. 154(b) by 81 days.

(21) Appl. No.: 09/904,440

(22) Filed: Jul. 12, 2001

(65) Prior Publication Data

US 2002/0016560 A1 Feb. 7, 2002

Related U.S. Application Data

(60) Provisional application No. 60/218,128, filed on Jul. 13, 2000.

(51) Int. Cl.[7] ..... A61H 9/00

(52) U.S. Cl. ..... 601/48; 601/150; 601/149; 601/151; 417/244; 417/557; 92/99; 92/140

(58) Field of Search ..... 417/244, 441, 417/557, 326, 53; 601/43, 44, 48, 49, 148, 149, 150, 151; 92/140, 98 R, 99

(56) References Cited

U.S. PATENT DOCUMENTS

| | | | | |
|---|---|---|---|---|
| 1,898,652 A | | 2/1933 | Williams | |
| 2,223,570 A | | 12/1940 | McMillin | |
| 2,575,398 A | * | 11/1951 | Schoeder | 417/571 |
| 2,588,192 A | | 3/1952 | Akerman et al. | |
| 2,626,601 A | | 1/1953 | Riley | |
| 2,707,948 A | | 5/1955 | Emerson | |
| 2,762,200 A | | 9/1956 | Huxley, III | |
| 2,762,366 A | | 9/1956 | Huxley, III | |
| 2,779,329 A | | 1/1957 | Huxley, III et al. | |
| 2,780,222 A | | 2/1957 | Polzin et al. | |
| 2,869,537 A | | 1/1959 | Chu | |
| 2,899,955 A | | 8/1959 | Huxley, III et al. | |
| 2,918,917 A | | 12/1959 | Emerson | |
| 3,029,743 A | | 4/1962 | Johns | |
| 3,043,292 A | | 7/1962 | Mendelson | |
| 3,063,444 A | | 11/1962 | Jobst | |
| 3,078,842 A | | 2/1963 | Gray | |
| 3,120,228 A | | 2/1964 | Huxley, III | |
| 3,164,100 A | * | 1/1965 | Hughes | 417/244 |
| 3,179,106 A | | 4/1965 | Meredith | |

(List continued on next page.)

FOREIGN PATENT DOCUMENTS

CA 1225889 8/1987

OTHER PUBLICATIONS

"Chronic bronchial asthma and emphysema," Geriatrics, Jun., 1996, pp. 139–158.

"Enhanced Tracheal Mucus Clearance with High Frequency Chest Wall Compression," Respiratory Disease, Sep. 1983, pp. 511–515.

(List continued on next page.)

*Primary Examiner*—Charles G. Freay

(57) ABSTRACT

A vest for a human body has an air core coupled to a pulsator operableto subject the vest to pulses of air which applies and releases high frequency pressure forces to the body. The pulsator has two diaphrams connected to an electric de motor with rotary to reciprocating linear motion transmitting mechanisms operable to generate air pulses in an air pulsing chamber. The diaphragms also increase the pressure in a manifold chamber. A check valve connects the manifold chamber with a pulsing chamber to allow pressurized air to flow from the manifold chamber into the pulsing chamber. An air flow control valve in commmunication with the manifold chamber is used to adjust the pressure of the air in the manifold and pulsing chambers.

69 Claims, 11 Drawing Sheets

U.S. PATENT DOCUMENTS

| | | | | |
|---|---|---|---|---|
| 3,288,132 | A | | 11/1966 | Meredith |
| 3,307,533 | A | | 3/1967 | Meredith et al. |
| 3,310,050 | A | | 3/1967 | Goldfarb |
| 3,577,977 | A | | 5/1971 | Ritzinger, Jr. et al. |
| 3,683,655 | A | | 8/1972 | White et al. |
| 3,760,801 | A | | 9/1973 | Borgeas |
| 3,885,554 | A | | 5/1975 | Rockwell, Jr. |
| 3,896,794 | A | | 7/1975 | McGrath |
| 3,993,053 | A | | 11/1976 | Grossan |
| 4,120,297 | A | | 10/1978 | Rabischong et al. |
| 4,135,503 | A | | 1/1979 | Romano |
| 4,178,922 | A | | 12/1979 | Curlee |
| 4,186,732 | A | | 2/1980 | Christoffel |
| 4,239,039 | A | | 12/1980 | Thompson |
| 4,424,806 | A | | 1/1984 | Newman et al. |
| 4,481,944 | A | | 11/1984 | Brunnell |
| 4,523,579 | A | | 6/1985 | Barry |
| 4,538,604 | A | | 9/1985 | Usry et al. |
| 4,577,626 | A | | 3/1986 | Marukawa et al. |
| 4,590,925 | A | | 5/1986 | Dillon |
| 4,621,621 | A | | 11/1986 | Marasalis |
| 4,676,232 | A | | 6/1987 | Olsson et al. |
| 4,682,588 | A | | 7/1987 | Curlee |
| 4,805,612 | A | | 2/1989 | Jensen |
| 4,815,452 | A | | 3/1989 | Hayek |
| 4,838,263 | A | | 6/1989 | Warwick et al. |
| 4,840,167 | A | * | 6/1989 | Olsson et al. ..... 601/41 |
| 4,928,674 | A | | 5/1990 | Halperin et al. |
| 4,930,498 | A | | 6/1990 | Hayek |
| 4,977,889 | A | | 12/1990 | Budd |
| 5,056,505 | A | | 10/1991 | Warwick et al. |
| 5,222,478 | A | | 6/1993 | Scarberry et al. |
| 5,235,967 | A | | 8/1993 | Arbisi et al. |
| 5,269,659 | A | | 12/1993 | Hampton et al. |
| 5,370,603 | A | | 12/1994 | Newman |
| 5,453,081 | A | | 9/1995 | Hansen |
| 5,490,820 | A | | 2/1996 | Schock et al. |
| 5,569,170 | A | | 10/1996 | Hansen |
| 5,606,754 | A | | 3/1997 | Hand et al. |
| 5,769,797 | A | | 6/1998 | Van Brunt et al. |
| 5,769,800 | A | | 6/1998 | Gelfand et al. |
| 5,836,751 | A | | 11/1998 | De Villiers |
| 6,030,353 | A | | 2/2000 | Van Brunt |
| 6,254,556 | B1 | | 7/2001 | Hansen et al. |

OTHER PUBLICATIONS

"Pheirpheral mucociliary clearance with high–frequency chest wall compression," Journal of Applied Physiology, Apr. 1985, pp. 1157–1163.

"Nitrogen Washout during Tidal Breathing with Superimposed High–Frequency Chest Wall Oscillation," Respiratory Disease, Aug. 1985, pp. 350–353.

"High–Frequency Chest Wall Oscillation," Chest, Feb. 1986, pp. 218–223.

"High Frequency Chest Wall Oscillation in Patients with Chronic Air–Flow Obstruction," Respiratory Disease, Dec. 1987, pp. 1355–1359.

"Mucus transport by high–frequency nonsymmetrical oscillatory airflow," Journal of Applied Physiology, Sep. 1988, pp. 1203–1209.

"Effect of Chest Wall Oscillation on Mucus Clearance: Comparison of Two Vibrators," Pediatric Pulmonology, Mar. 1989, pp. 122–126.

"Tracheal mucus clearance in high–frequency oscillation: effect of peak flow rate bias," European Respiratory Journal, Jan. 1990, pp. 6–13.

"High–frequency Chest Compression System to Aid in Clearance of Mucus from the Lung," Biomedical Instrumentation & Technology, Jul./Aug. 1990, pp. 289–294.

"The Long–Term Effect of High–Frequency Chest Compression Therapy on Pulmonary Complications of Cystic Fibrosis," Pediatric Pulmonology, Nov. 1991, pp. 265–271.

"Preliminary Evaluation of High–Frequency Chest Compression for Secretion Clearance in Mechanically Ventilated Patients," Respiratory Care, Oct. 1993, pp. 1081–1087.

"Effects of high frequency chest compression on respiratory system mechanics in normal subjects and cystic fibrosis patients," Canadian Respiratory Journal, Mar. 1995, pp. 40–46.

"User's Manual XP–AC Series Pulse–Width Modulated, Adjustable Speed Drives for DC Brush Motors," Minarik Corporation, Apr. 1996.

"Artificial Ventilation," Technion Institute of Technology Faculty of Medicine, date unknown.

* cited by examiner

BODY PULSATING METHOD AND APPARATUS

CROSS REFERENCE TO RELATED APPLICATION

This application claims the benefit of U.S. Provisional Application Serial No. 60/218,128 filed Jul. 13, 2000.

FIELD OF THE INVENTION

The invention is directed to a medical device and method to apply repetitive compression forces to the body of a person to aid blood circulation, loosening and elimination of mucus from the lungs of a person and relieve muscular and nerve tensions.

BACKGROUND OF THE INVENTION

Clearance of mucus from the respiratory tract in healthy individuals is accomplished primarily by the body's normal mucociliary action and cough. Under normal conditions these mechanisms are very efficient. Impairment of the normal mucociliary transport system or hypersecretion of respiratory mucus results in an accumulation of mucus and debris in the lungs and can cause severe medical complications such as hypoxemia, hypercapnia, chronic bronchitis and pneumonia. These complications can result in a diminished quality of life or even become a cause of death. Abnormal respiratory mucus clearance is a manifestation of many medical conditions such as pertussis, cystic fibrosis, atelectasis, bronchiectasis, cavitating lung disease, vitamin A deficiency, chronic obstructive pulmonary disease, asthma, and immotile cilia syndrome. Exposure to cigarette smoke, air pollutants and viral infections also adversely affect mucociliary function. Post surgical patients, paralyzed persons, and newborns with respiratory distress syndrome also exhibit reduced mucociliary transport.

Chest physiotherapy has had a long history of clinical efficacy and is typically a part of standard medical regimens to enhance respiratory mucus transport. Chest physiotherapy can include mechanical manipulation of the chest, postural drainage with vibration, directed cough, active cycle of breathing and autogenic drainage. External manipulation of the chest and respiratory behavioral training are accepted practices as defined by the American Association for Respiratory Care Guidelines, 1991. The various methods of chest physiotherapy to enhance mucus clearance are frequently combined for optimal efficacy and are prescriptively individualized for each patient by the attending physician.

Cystic fibrosis (CF) is the most common inherited life-threatening genetic disease among Caucasians. The genetic defect disrupts chloride transfer in and out of cells, causing the normal mucus from the exocrine glands to become very thick and sticky, eventually blocking ducts of the glands in the pancreas, lungs and liver. Disruption of the pancreatic glands prevents secretion of important digestive enzymes and causes intestinal problems that can lead to malnutrition. In addition, the thick mucus accumulates in the lung's respiratory tracts, causing chronic infections, scarring, and decreased vital capacity. Normal coughing is not sufficient to dislodge these mucus deposits. CF usually appears during the first 10 years of life, often in infancy. Until recently, children with CF were not expected to live into their teens. However, with advances in digestive enzyme supplementation, anti-inflammatory therapy, chest physical therapy, and antibiotics, the median life expectancy has increase to 30 years with some patients living into their 50's and beyond. CF is inherited through a recessive gene, meaning that if both parents carry the gene, there is a 25 percent chance that an offspring will have the disease, a 50 percent chance they will be a carrier and a 25 percent chance they will be genetically unaffected. Some individuals who inherit mutated genes from both parents do not develop the disease. The normal progression of CF includes gastrointestinal problems, failure to thrive, repeated and multiple lung infections, and death due to respiratory insufficiency. While some patients experience grave gastrointestinal symptoms, the majority of CF patients (90 percent) ultimately succumb to respiratory problems.

A demanding daily regimen is required to maintain the CF patient's health, even when the patient is not experiencing acute problems. A CF patient's CF daily treatments may include:

- Respiratory therapy to loosen and mobilize mucus;
- Inhalation therapy with anti-inflammatory drugs, bronchodilators and antibiotics for infections;
- Oral and intravenous antibiotics to control infection;
- Doses of Pulmozyme to thin respiratory mucus;
- 20 to 30 pancreatic enzyme pills taken with every meal to aid digestion;
- a low-fat, high-protein diet;
- Vitamins and nutritional supplements; and
- Exercise.

A lung transplant may be the only hope for patients with end stage cystic fibrosis.

Virtually all patients with CF require respiratory therapy as a daily part of their care regimen. The buildup of thick, sticky mucus in the lungs clogs airways and traps bacteria, providing an ideal environment for respiratory infections and chronic inflammation. This inflammation causes permanent scarring of the lung tissue, reducing the capacity of the lungs to absorb oxygen and, ultimately, sustain life. Respiratory therapy must be performed, even when the patient is feeling well, to prevent infections and maintain vital capacity. Traditionally, care providers perform Chest Physical Therapy (CPT) one to four times per day. CPT consists of a patient lying in one of twelve positions while a caregiver "claps" or pounds on the chest and back over each lobe of the lung. To treat all areas of the lung in all twelve positions requires pounding for half to three-quarters of an hour along with inhalation therapy. CPT clears the mucus by shaking loose airway secretions through chest percussions and draining the loosened mucus toward the mouth. Active coughing is required to ultimately remove the loosened mucus. CPT requires the assistance of a caregiver, often a family member but a nurse or respiratory therapist if one is not available. It is a physically exhausting process for both the CF patient and the caregiver. Patient and caregiver non-compliance with prescribed protocols is a well-recognized problem that renders this method ineffective. CPT effectiveness is also highly technique sensitive and degrades as the giver becomes tired. The requirement that a second person be available to perform the therapy severely limits the independence of the CF patient.

Artificial respiration devices for applying and relieving pressure on the chest of a person have been used to assist in lung breathing functions, and loosening and eliminating mucus from the lungs of CF persons. Subjecting the person's chest and lungs to pressure pulses or vibrations decreases the viscosity of lung and air passage mucus, thereby enhancing fluid mobility and removal from the lungs. These devices use vests having air-accommodating bladders that surround the chests of persons. Mechanical mechanisms, such as solenoid or motor-operated air valves, bellows and pistons are disclosed in the prior art to supply air under pressure to diaphragms and bladders in regular pattern or pulses. The bladder worn around the thorax of the CF person repeatedly compresses and releases the thorax at frequencies as high as 25 cycles per second. Each compression produces a rush of air through the lobes of the lungs that shears the secretions from the sides of the airways and propels them toward the mouth where they can be removed by normal coughing. External chest manipulation with high frequency chest wall oscillation was reported in 1966. Beck G J. *Chronic Bronchial Asthma and Emphysema. Rehabilitation and Use of Thoracic Vibrocompression, Geriatrics* (1966), 21: 139–158.

G. A. Williams in U.S. Pat. No. 1,898,652 discloses an air pulsator for stimulating blood circulation and treatment of tissues and muscles beneath the skin. A reciprocating piston is used to generate air pressure pulses which are transferred through a hose to an applicator having a flexible diaphragm. The pulsating air generated by the moving piston imparts relatively rapid movement to the diaphragm which subjects the person's body to pulsing forces.

J. D. Ackerman et al in U.S. Pat. No. 2,588,192 disclose an artificial respiration apparatus having a chest vest supplied with air under pressure with an air pump. Solenoid-operated valves control the flow of air into and out of the vest in a controlled manner to pulsate the vest, thereby subjecting the person's chest to repeated pressure pulses.

J. H. Emerson in U.S. Pat. No. 2,918,917 discloses an apparatus for exercising and massaging the airway and associated organs and loosening and removing mucus therefrom. A blower driven with a motor creates air pressure for a device that fits over a person's nose and mouth. A diaphragm reciprocated with an electric motor pulses the air flowing to the device and the person's airway. The speed of the motor is controlled to regulate the number of vibrations per minute.

R. F. Gray in U.S. Pat. No. 3,078,842 discloses a bladder for cyclically applying an external pressure to the chest of a person. A pressure alternator applies air pressure to the bladder. A pulse generator applies air pressure to the bladder to apply pressure pulses to the chest of the person.

R. S. Dillion in U.S. Pat. No. 4,590,925 uses an inflatable enclosure to cover a portion of a person's extremity, such as an arm or leg. The enclosure is connected to a fluid control and pulse monitor operable to selectively apply and remove pressure on the person's extremity.

W. J. Warwick and L. G. Hansen in U.S. Pat. Nos. 4,838,263 and 5,056,505 disclose a chest compression apparatus having a chest vest surrounding a person's chest. A motor-driven rotary valve allows air to flow into the vest and vent air therefrom to apply pressurized pulses to the person's chest. An alternative pulse pumping system has a pair of bellows connected to a crankshaft with rods operated with a dc electric motor. The speed of the motor is regulated with a controller to control the frequency of the pressure pulses applied to the vest. The patient controls the pressure of the air in the vest by opening and closing the end of an air vent tube.

C. N. Hansen in U.S. Pat. Nos. 5,453,081 and 5,569,170 discloses an air pulsating apparatus for supplying pulses of air to an enclosed receiver, such as a vest located around a person's chest. The apparatus has a casing with an internal chamber containing a diaphragm. An electric operated device, such as a solenoid, connected to the diaphragm is operated with a pulse generator to vibrate the diaphragm to pulse the air in the chamber. A hose connects the chamber with the vest to transfer air and air pulses to the vest which applies pressure pulses to the person's chest.

N. P. Van Brunt and D. J. Gagne in U.S. Pat. Nos. 5,769,797 and 6,036,662 disclose an oscillatory chest compression device having a wall with an air chamber and a diaphragm mounted on the wall and exposed to the air chamber. A rod pivotally connected to the diaphragm and rotatably connected to a crankshaft transmits force to the diaphragm during rotation of the crankshaft. An electric motor drives the crankshaft at selected controlled speeds to regulate the frequency of the air pulses generated by the moving diaphragm. An air flow generator, shown as a blower, delivers air to the air chamber to maintain the pressure of the air in the chamber. Controls for the motors that move the diaphragm and blower are responsive to the pressure of the air in the air chamber. These controls have air pressure responsive feedback systems that regulate the operating speeds of the motors to control the pulse frequency and air pressure in the vest.

SUMMARY OF THE INVENTION

The invention comprises a vest used to apply repetitive pressure pulses to a human body and a pulsator for generating air pressure pulses that are transmitted to the vest to provide secretion and mucus clearance therapy. The vest has a non-elastic outer cover attached to a flexible liner. An air core of flexible material located between the cover and liner is connected with a hose to an air pulsator operable to generate repetitive air pressure pulses which are transmitted to the air core. The air pressure pulses subjected to the air core create repetitive pressure pulses that are transmitted to the body of a person wearing the vest whereby high frequency chest wall oscillations or pulses enhance mucus clearance in the respiratory system of the person. The pulsator has a casing with an internal air pulsing chamber in air communication with the hose which transmits air and air pressure pulses to the air core. The air pressure pulses are generated with a movable diaphragm mounted on the casing having one side in communication with the air pulsing chamber. A motion transmitting mechanism driven with a variable speed power unit linearly reciprocates the diaphragm to repetitively increase and decrease the pressure of the air in the internal chamber thereby generating air pressure pulses. The operating speed of the power unit is regulated to change the air pressure pulse frequency. The case has an air pumping chamber in communication with the other side of the diaphragm. The reciprocating diaphragm pumps air under pressure into the air pulsating chamber. A one-way valve mounted on the casing allows air under pressure to flow from the air pumping chamber into the air pulsating chamber and prevent the reverse flow of air from the air pulsating chamber back to the air pumping chamber thereby maintaining the air in the air pulsating chamber at a desired pressure. An adjustable air flow restrictor limits the flow of air into the air pumping chamber thereby controlling the pressure of the air in the air pumping chamber, air pulsating chamber, and air core located in the vest.

The preferred embodiment of the body pulsating apparatus has a case with walls surrounding an air pulsing chamber. An elongated hose carries air and air pulses to an air core in a vest located about the upper body of a person. The case has an internal wall that separates the air pulsing chamber from an air manifold chamber. One or more one-way valves mounted on the internal wall allow air to flow from the air manifold chamber into the air pulsing chamber and prevent reverse flow of air back from the air pulsing chamber into the air manifold chamber. The case has top and bottom openings covered with diaphragms attached with flexible peripheral members to the case to enclose the air pulsing chamber. Located within the air pulsing chamber is a pair of linear reciprocating motion transmitting mechanisms for linearly moving the diaphragms in straight line opposite directions to pulse the air in the air pulsing chamber. The motion transmitting mechanisms are scotch yoke devices which provide the diaphragms with straight line harmonic motions. An electric motor rotates a common shaft having a pair of eccentrics that laterally moves shuttles and reciprocates yokes. The yokes are fixed directly to the diaphragms. The operating speed of the motor is controlled with a motor controller wired to a timer and a source of electric power. The controller is manually adjustable to change the speed of the motor which is proportional to air pulse frequency in the air pulsing chamber. Covers located over the diaphragms attached to the casing have air pumping chambers in communication with the manifold chamber. The reciprocating movements of the diaphragms draws air through an air flow control into air manifold chamber and pumping chambers and compresses the air in the air manifold chamber. The pressure of the air in the air manifold chamber is regulated with a manually adjustable air flow control valve. Restricting the flow of air into the manifold chamber reduces the pressure of the air in the air manifold chamber. When the pressure of the air in the air manifold chamber exceeds the air pressure in the air pulsing chamber, the one-way valve opens to allow air to flow into the air pulsing chamber, through the hose, and into the air core thereby inflating the air core which applies pressure to the upper body of a person wearing the vest. The reciprocating movements of the diaphragms pulse the pressurized air at a frequency determined by the speed of the electric motor that drives the scotch yokes.

DESCRIPTION OF PREFERRED EMBODIMENT

Figure 1:
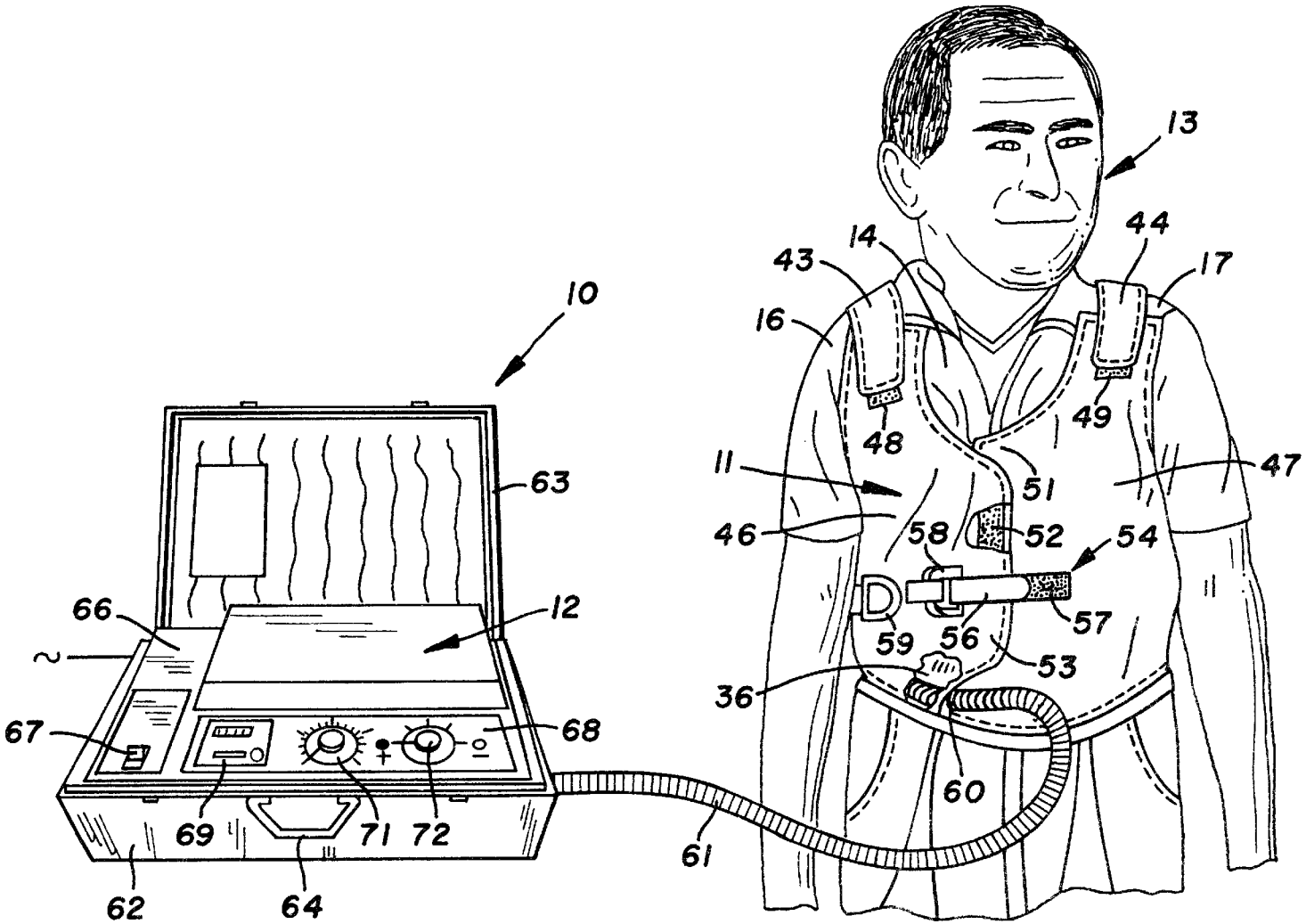
FIG. 1 is a diagrammatic view of the air pressure and pulse generator of the invention coupled to an air core located in a vest located around the chest of a person.
Figure 3:
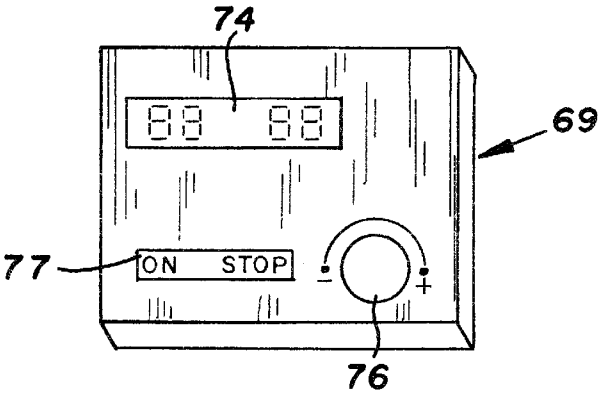
FIG. 3 is a top plan view of the adjustable timer of the air pressure and pulse generator of FIG. 1.

The body pulsating apparatus, indicated generally at 10 in FIG. 1, has a vest 11 and an air pressure and pulse generator 12 operable to apply repetitive pressure pulses to the vest located about a human body to provide secretion and mucus clearance therapy. Respiratory mucus clearance is applicable to many medical conditions, such as pertussis, cystic fibrosis, atelectasis, bronchiectasis, cavitating lung disease, vitamin A deficiency, chronic obstructive pulmonary disease, asthma, and immobile cilia syndrome. Post surgical patients, paralyzed persons, and newborns with respiratory distress syndrome have reduced mucociliary transport. Apparatus 10 provides high frequency chest wall oscillations or pulses to enhance mucus clearance in a person 13 with reduced mucociliary transport.

Figure 2:
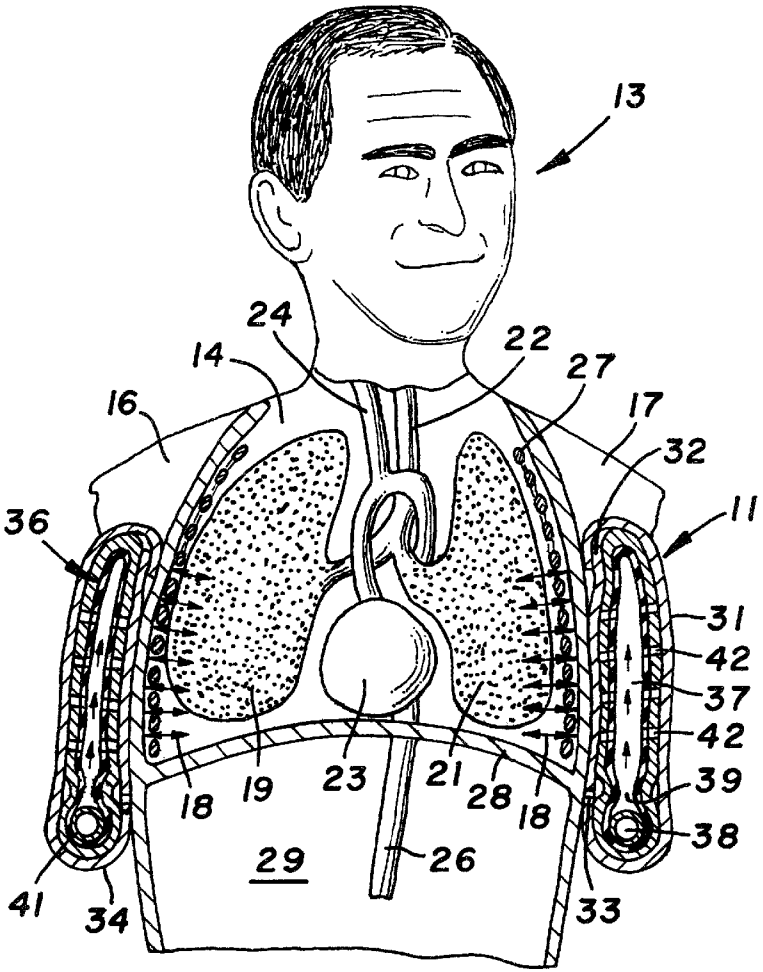
FIG. 2 is a diagrammatic view, partly sectioned, of the air core, vest, and person of FIG. 1.

Vest 11 located around the person's upper body or thorax 14 is supported on the person's shoulders 16 and 17. As shown in FIG. 2, vest 11 expanded into substantial surface contact with the exterior of upper body 14 functions to apply repeated compression or pressure pulses, shown by arrows 18 to body 14. The reaction of body 14 to the pressure pulses causes repetitive expansion of the body when the pressure pulses are in the low pressure phase of the pressure cycle. The pressure pulses subjected to lungs 19 and 21 and trachea 22 provide secretions and mucus clearance therapy. The thoracic cavity occupies only the upper part of the thoracic cage and contains right and left lungs 19 and 21, heart 23, arteries 24 and 26, and rib cage 27. The repeated pressure pulses applied to thorax 14 stimulates heart 23 and blood flow in arteries 24 and 26 and veins in the chest cavity. Muscular and nerve tensions are also relieved by the repetitive pressure pulses imparted to the front, sides, and back portions of thorax 14. The lower part of the thoracic cage comprises the abdominal cavity 29 which reaches upward as high as the lower tip of the sternum so as to afford considerable protection to the large and easily injured abdominal organs, such as the liver, spleen, stomach, and kidneys. The two cavities are separated by a dome-shaped diaphragm 28. Rib cage 27 has twelve ribs on each side of the trunk. The ribs consist of a series of thin, curved, rather elastic bones which articulate posteriorly with the thoracic vertebrae. The spaces between successive ribs are bridged by intercostal muscles. The rib cage 29 aids in the distribution of the pressure pulses to the lungs 19 and 21 and trachea 22.

Vest 11 has an outside cover 31 comprising a non-elastic material, such as a nylon fabric. Other types of materials can be used for cover 31. Cover 31 is secured to a flexible inside liner 32 located adjacent and around body 14. Liner 32 is a flexible fabric, such as a porous cotton fabric, that allows air to flow through the fabric toward body 14. A closure device 33, shown as a zipper, secures the bottom of liner 32 to an upwardly directed end portion 34 of cover 31. An air core or bladder 36 having internal chamber 37 and a manifold passage 38 is located between cover 31 and liner 32. A plurality of air passages 39 between passage 38 and chamber 37 allow air to flow upwardly into chamber 37. An elongated coil spring 41 in the lower portion of air core 36 inside manifold passage 38 maintains the manifold passage 38 open. Other types of structures that maintain manifold passage 38 open and allow air to flow through passage 38 can be used in the lower portion of air core 36. The end portion 33 of non-elastic cover 31 and coil spring 41 substantially reduces the inward pressure of the vest on the abdominal cavity 29 and organs therein and reduces stress on the digestive system. Air core 36 has a plurality of vertically aligned air flow control apertures 42 that restrict the flow of air from air core chamber 37 into the space between cover 31 and liner 32. The air flowing through porous liner 32 ventilates and cools body 14 surrounded by vest 11.

Returning to FIG. 1, vest 11 has a pair of upright shoulder straps 43 and 44 laterally separated with a concave upper back edge. Upright front chest portions 46 and 47 are separated from straps 43 and 44 with concave curved upper edges which allow vest 11 to fit under the person's arms. Releasable fasteners, such as loop pads 48 and 49, secured to the outer surfaces of chest portions 46 and 47 cooperate with hook pads (not shown) secured to the insides of shoulder straps 43 and 44 to releasably connect shoulder straps 43 and 44 to chest portions 46 and 47. Shoulder straps 43 and 44 extend forwardly over shoulders 16 and 17 and downwardly over chest portions 46 and 47. The hook and lop pads are releasable VELCRO fasteners that connect shoulder straps 43 and 44 to chest portions 46 and 47 and hold chest portions 46 and 47 adjacent the front of body 14.

Vest 11 has a first lateral end flap 51 extended outwardly at the left side of the vest. A rectangular loop pad 52 secured to the outside of the end flap 51 cooperates with hook pads on a second lateral end flap 53 on the right side of vest 11 to hold vest 11 around body 14. The hook and loop pads are VELCRO fasteners that allow vest 11 to be tightly wrapped around body 14.

As shown in FIG. 1, a releasable retainer 54 connected to the vest end flaps hold the flaps 51 and 53 in over lapped positions and prevents the releasable hook and loop fasteners 52 from disengaging during the application of repetitive pulse to the body 14 on the person 13. Retainer 54 comprises an elongated strap 56 secured at one end thereof to chest portion 53. Opposite ends of strap 56 have hook and loop releasable fasteners 57 that allow strap 56 to be fastened into a D-ring. A pair of D-rings 58 and 59 attached to chest portion 46 are aligned with strap 56. Strap 56 is looped through D-ring 58 and connected with fasteners 57 to hold the vest end flaps 51 and 53 and vest 11 around the body 14 of the person. The free end of strap 56 can be quickly pulled to release fasteners 57 and disengage retainer 54.

In use, vest 11 is placed about the person's body 14, as shown in FIG. 1, and held in place with shoulder straps 43 and 44. Releasable fasteners 48 and 49 secure straps 43 and 44 to chest portions 46 and 47. The vertical location of vest 11 on body 14 is adjusted by changing the connection relationship of straps 43 and 44 on releasable fasteners 48 and 49. The circumferential location of vest 11 is maintained in a light fit around the person's body 13 with releasable fasteners 52. Retainer 54 maintains fasteners 52 in engagement with each other and prevents disengagement during the pulsating of vest 11. Strap 56 of retainer 54 is looped through one of the D-rings 58, 59 and attached together with hook and loop fasteners 57. Air pulsator 12 is then connected with hose 61 to tube 62 at and end of to apply repetitive pressure pulses to body 14 of person 13.

Air pressure and pulse generator 12 is mounted in a case 62 having an open top and a cover 63 hinged to case 62 operable to close case 62. A handle 64 pivotally mounted on case 62 is used as a hand grip to facilitate transport of generator 12. Case 62 and cover 63 have overall dimensions that allow the case to be an aircraft carryon item.

Air pressure and pulse generator 12 has a top member 66 mounted on case 62 enclosing the operating elements of the pulsator. Top member 66 is not readily removable from case 62 to prohibit unauthorized adjustments and repairs of the operating components of the air pressure and pulse generator 12. Top member 67 supports a main electric power switch 67 and a front panel 68 having an operating timer 69, a pulse frequency control knob 71 and an air pressure control knob 73. Knobs 71 and 72 are manually rotated to adjust the frequency of the air pressure pulses and the air pressure in vest air core 36. Timer 69 has a numerical read out panel 74 displaying count down time in minutes and seconds of a treatment cycle. A control knob 76 is used to select a time of a treatment cycle of between 0 to 30 minutes. The selected time period is registered on panel 74. An ON and STOP switch 77 actuates timer 69 and pulsator motor 118. Frequency control knob 71 and regulates a motor controller which controls the air pulse frequency from 5 to 25 cycles per second. The adjustment of the air pressure in air core 36 is controlled by turning knob 72. The air pressure in air core 36 is controlled between atmosphere pressure and one psi.

Figure 5:
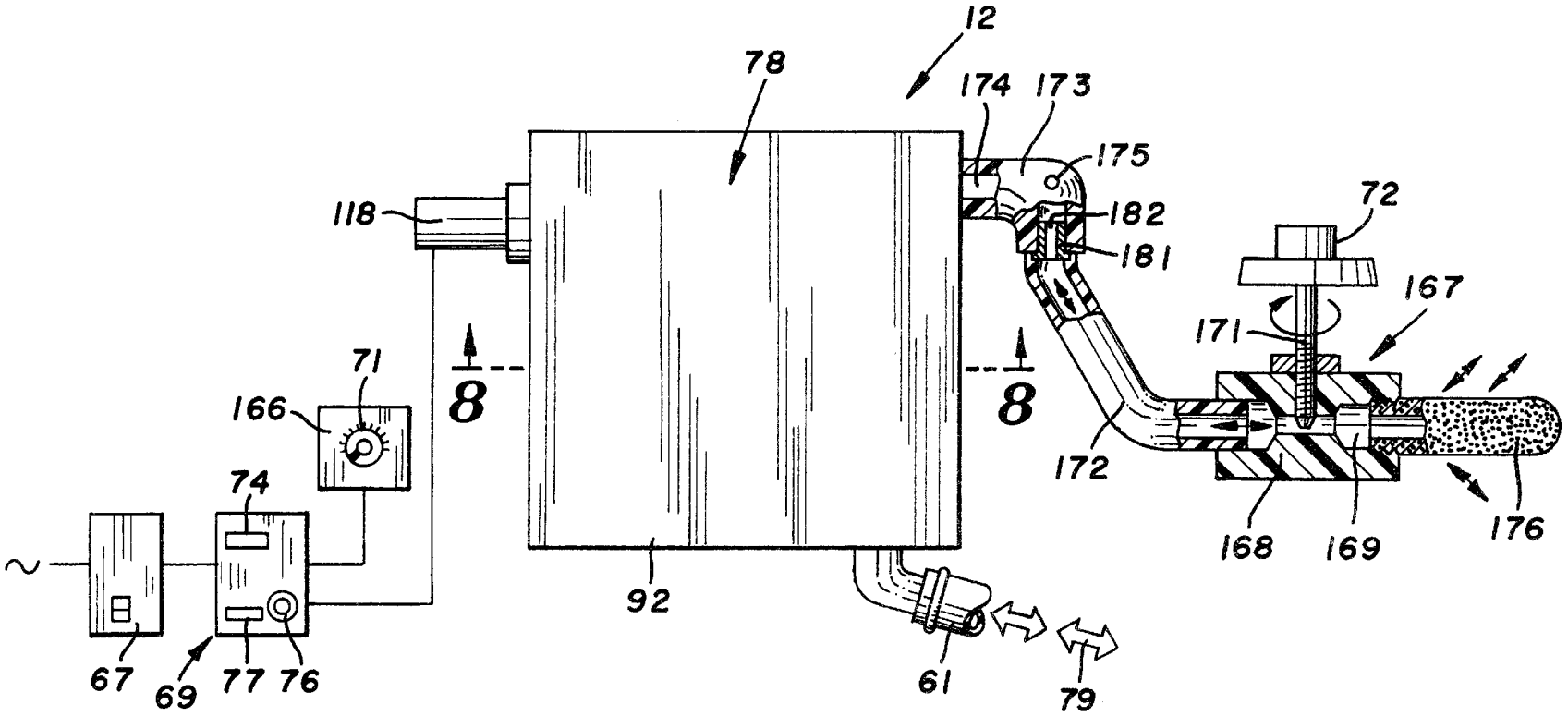
FIG. 5 is a diagrammatic view of the air pressure and pulsating apparatus of FIG. 1.
Figure 6:
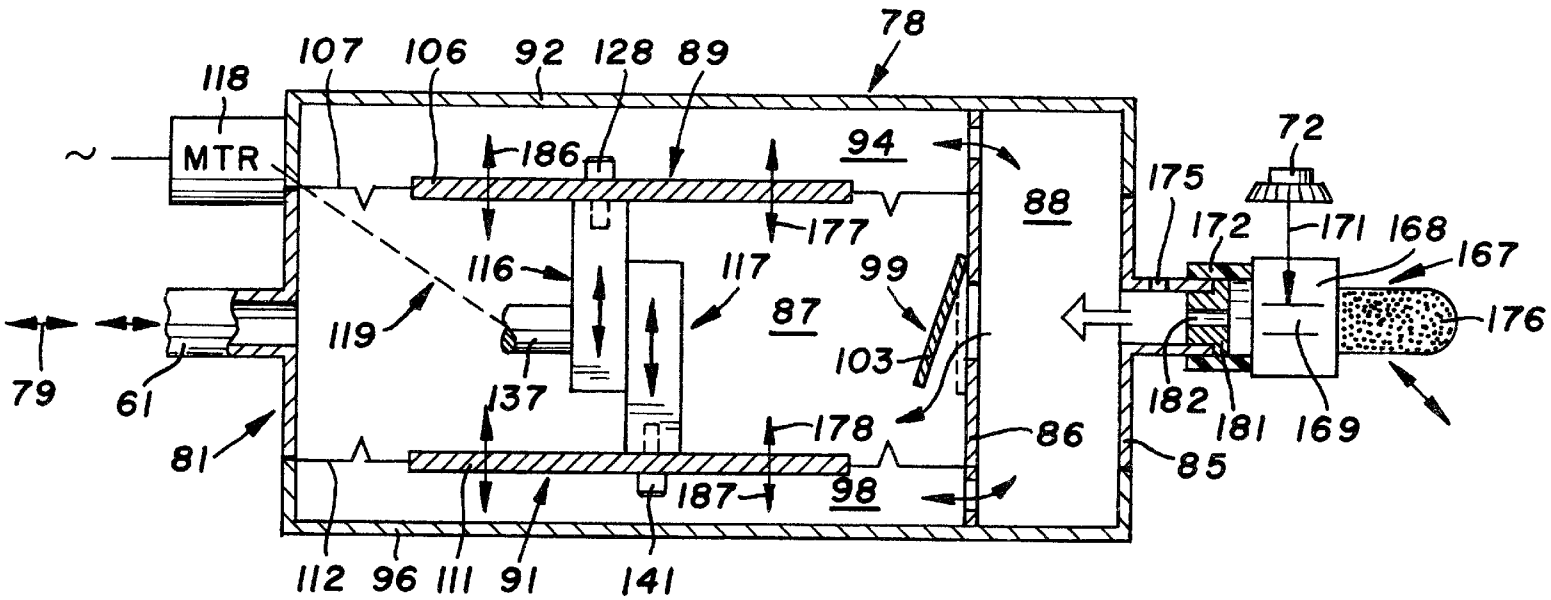
FIG. 6 is a cross-sectional diagrammatic view of the air pressure and pulse generator of FIG. 1.
Figure 7:
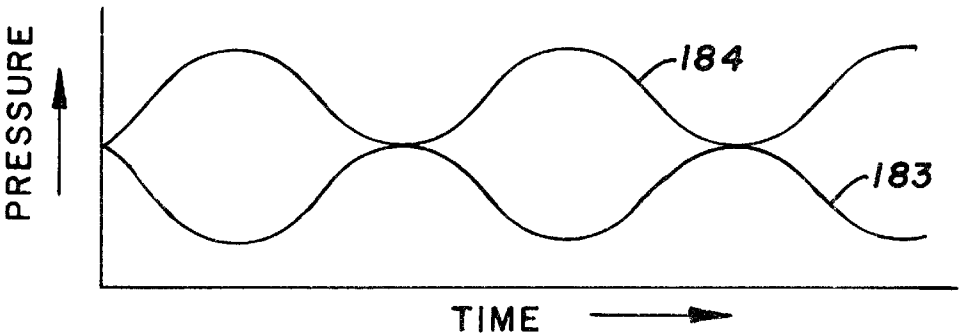
FIG. 7 is a pressure time graph of the air pressure and pulse generator of FIG. 1.
Figure 8:
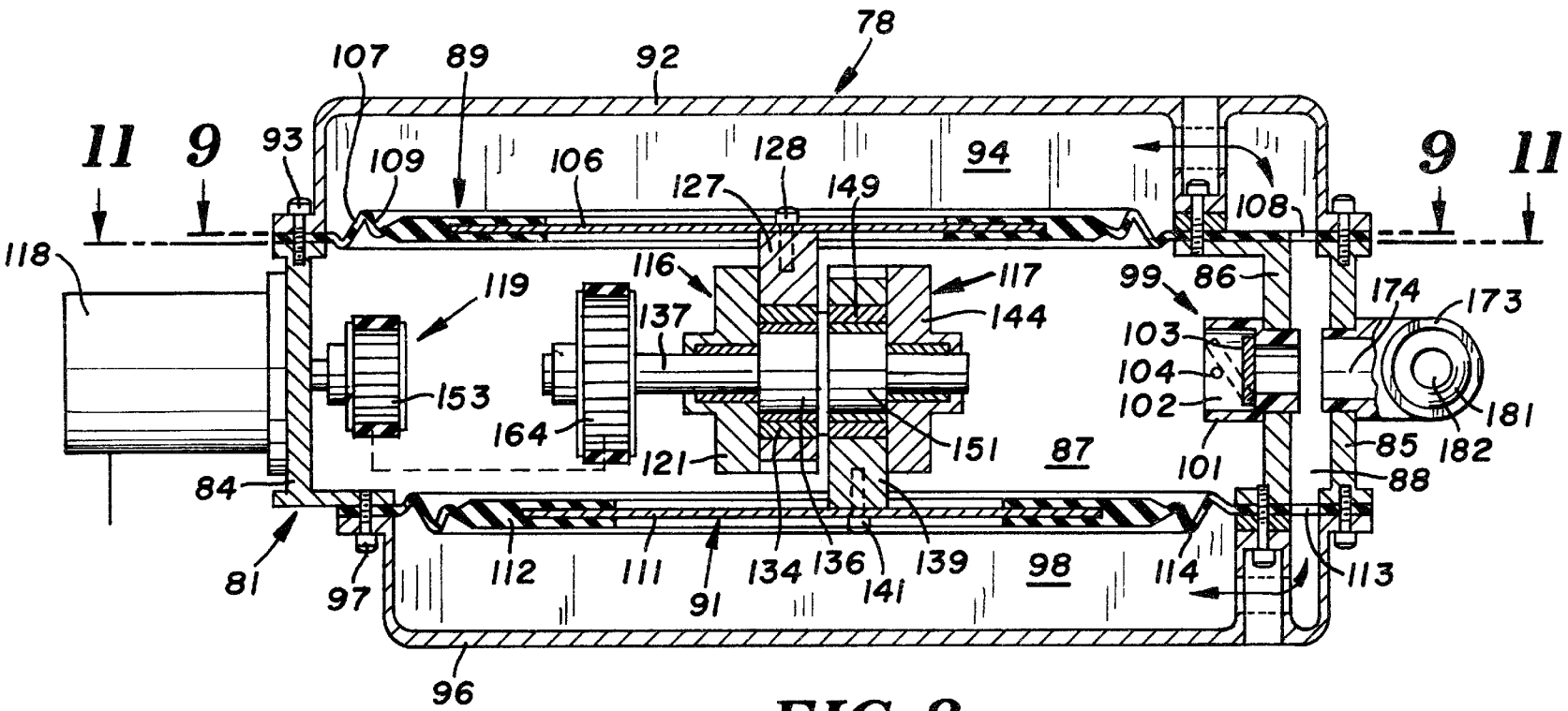
FIG. 8 is an enlarged sectional view taken along line 8—8 of FIG. 5.
Figure 9:
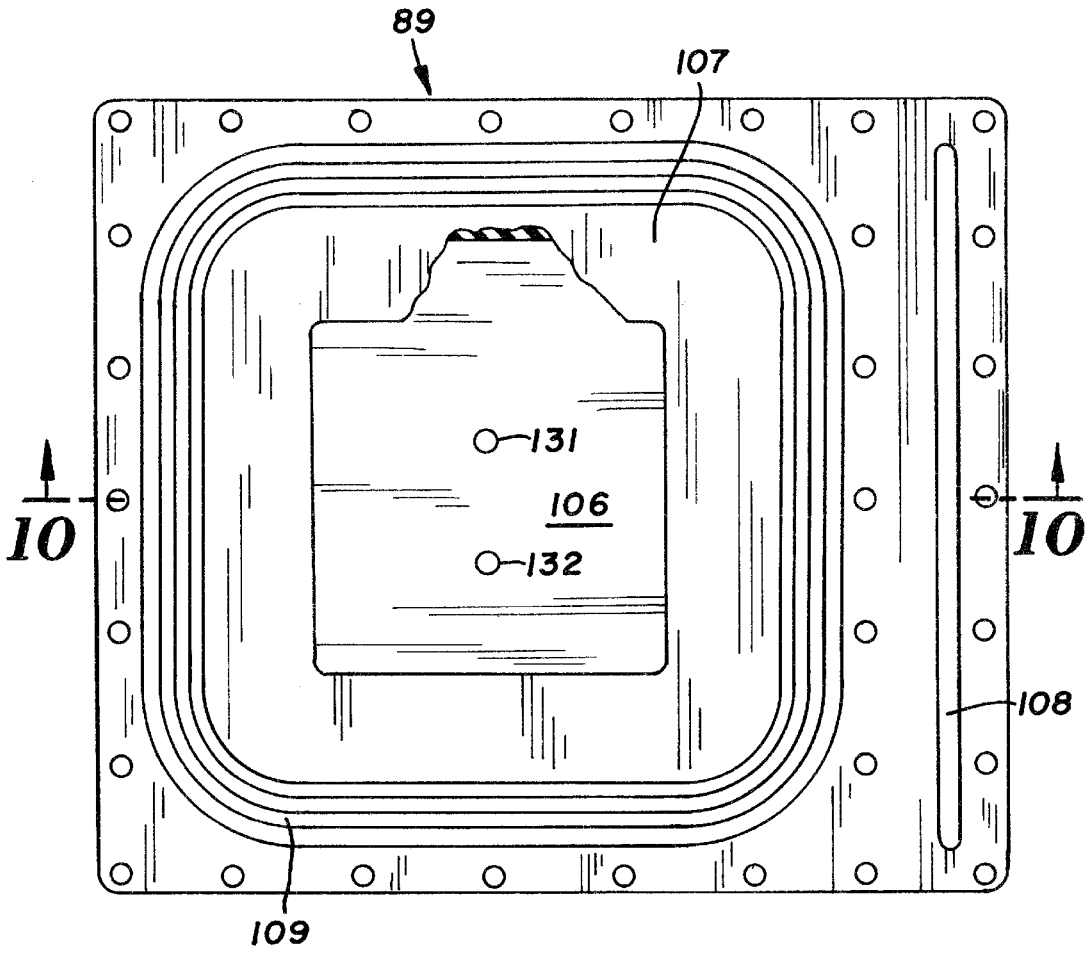
FIG. 9 is a sectional view taken along line 9—9 of FIG. 8.
Figure 10:
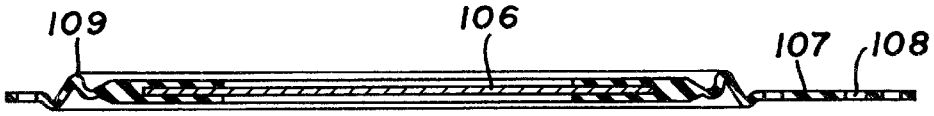
FIG. 10 is a sectional view taken along line 10—10 of FIG. 9.

As shown in FIGS. 5, 6 and 7, air pressure and air pulse generator 12 has a combined air pulsator and pump unit 78 operable to create air pressure pulses, shown by arrows 79, which are transported by hose 61 to air core 36. Unit 78 has a rectangular metal case 81 having upright side walls 82 and 83 joined to end walls 84 and 85. An internal wall 86 extended between and joined to side walls 82 and 83 separates an air pulsing chamber 87 from a manifold or vestibule chamber 88. Manifold chamber 88 is between end wall 85 and inside wall 86. The top and bottom of casing 81 is open. A pair of diaphragms 89 and 91 mounted on casing 81 close the casing openings to enclose the air pulsing chamber 87 located between diaphragms 89 and 91. A first pan-shaped cover 92 secured to the top of case 81 with fasteners 93 is located outwardly of diaphragm 89. The space between cover 92 and diaphragm 89 is a first pumping chamber 94 in fluid communication with manifold chamber 88 to allow air to flow into and out of chamber 94. A second pan-shaped cover 96 secured to the bottom of case 81 with fasteners 97 is located outwardly from diaphragm 91. The space between cover 96 and diaphragm 91 is a second air pumping chamber 98 in fluid communication with the manifold chamber 88 to allow air to flow between chambers 88 and 98. Air flows from pumping chambers 94 and 98 into manifold chamber 88 and from manifold chamber 88 into pulsing chamber 87 through a one-way valve or check valve 99, shown by arrow 100 in FIG. 14. Valve 99 when closed, as shown in FIG. 8, prevents the flow of air from pulsing chamber 87 back to manifold chamber 88. Valve 99, shown in FIG. 8, has a cylindrical housing 101 mounted on wall 86. Housing 101 has a passage 102 open to chambers 87 and 88 accommodating a valving member or disk 103 movable between open and closed positions. A transverse pin 104 mounted on housing 101 retains disk 103 in passage 102 and provides a fulcrum for disk 103 to allow disk 103 to pivot to its open position. One or more one-way valves mounted on wall 86 can be used to permit air to flow from manifold chamber into pulsating chamber 87 and block reverse flow of air from pulsating chamber 87 back to manifold chamber 88.

Diaphragm 89 has a rectangular rigid metal plate 106 joined to a peripheral flexible flange 107 of rubber or plastic. The inner portion of flange 107 is bifurcated and bonded to opposite sides of plate 106. The outer portion of flange 107 is clamped with fasteners 93 between cover 92 and casing 81. As shown in FIGS. 8, 9, 14 and 15, flange 107 has an opening 108 allowing air to flow between first pumping chamber 94 and manifold chamber 88. Flexible flange 107 has an accordion fold section 109 comprising upward and downward directed ribs that allow linear lateral movement of plate 106 without stretching and stressing the flexible material of flange 107. Diaphragm 91 has a rigid metal plate 11 located on the bottom side of chamber 87 and parallel to plate 106. A flexible flange 112 joined to plate 106 is clamped with fasteners 97 between casing 81 and cover 96. Flange 112 has an opening 113 allowing air to flow between manifold chamber 88 and second pumping chamber 98. A middle section of flange 112 around plate 111 has an accordion fold section that allows linear lateral movement of plate 111 without stretching and stressing the flexible material of flange 112.

Figure 11:
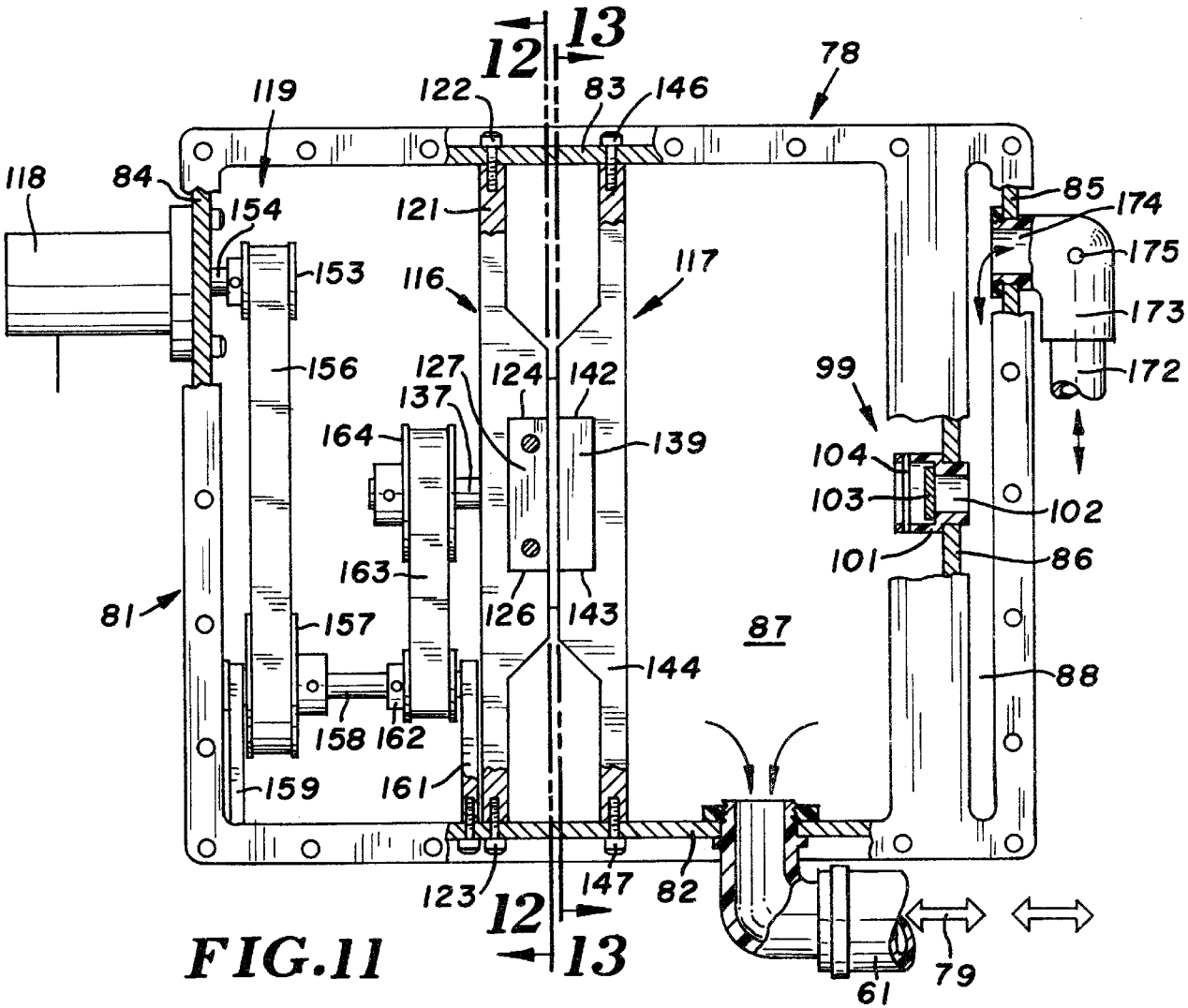
FIG. 11 is a sectional view taken along line 11—11 of FIG. 8.
Figure 13:
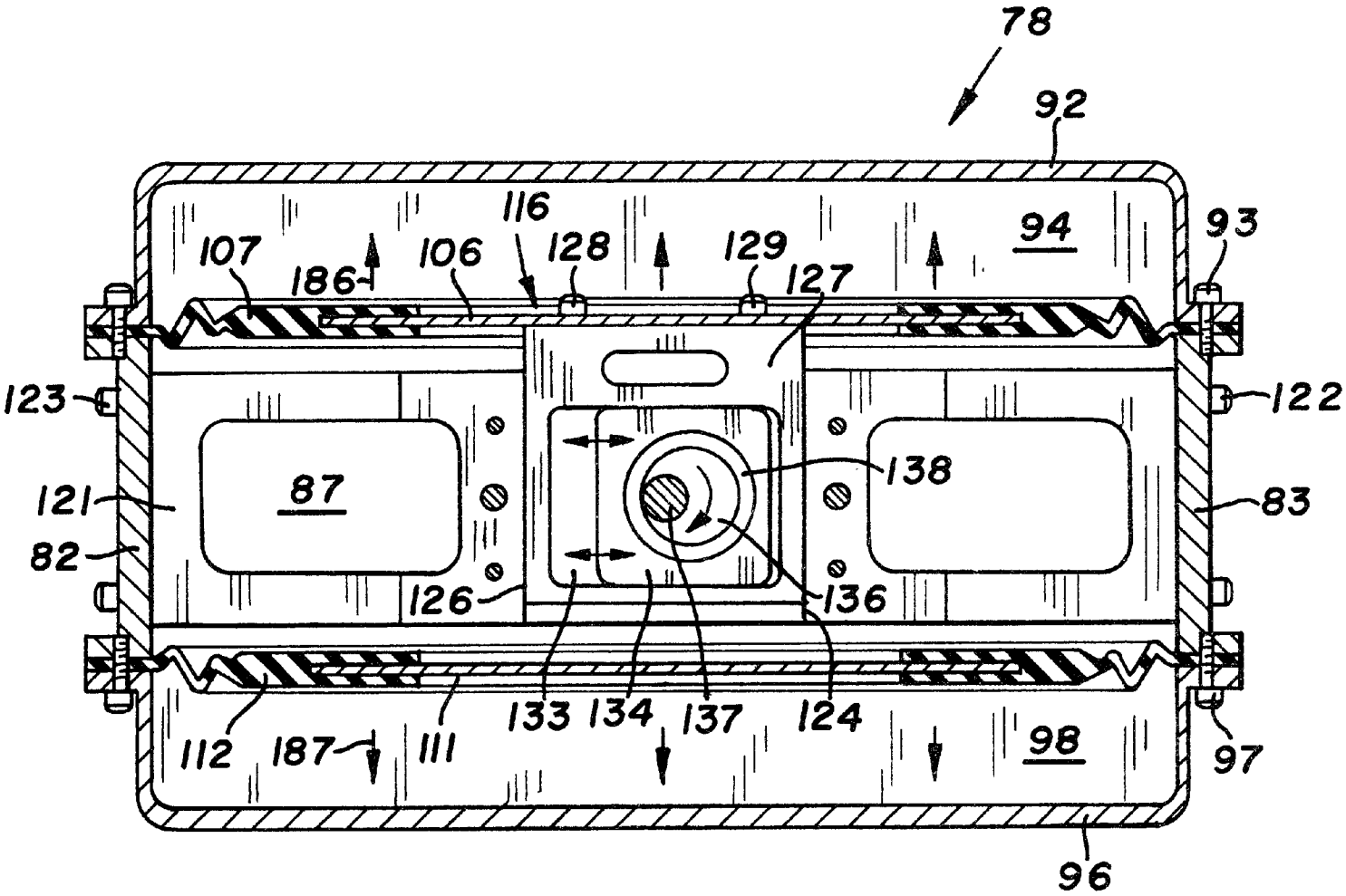
FIG. 13 is a sectional view taken along line 13—13 of FIG. 11.
Figure 14:
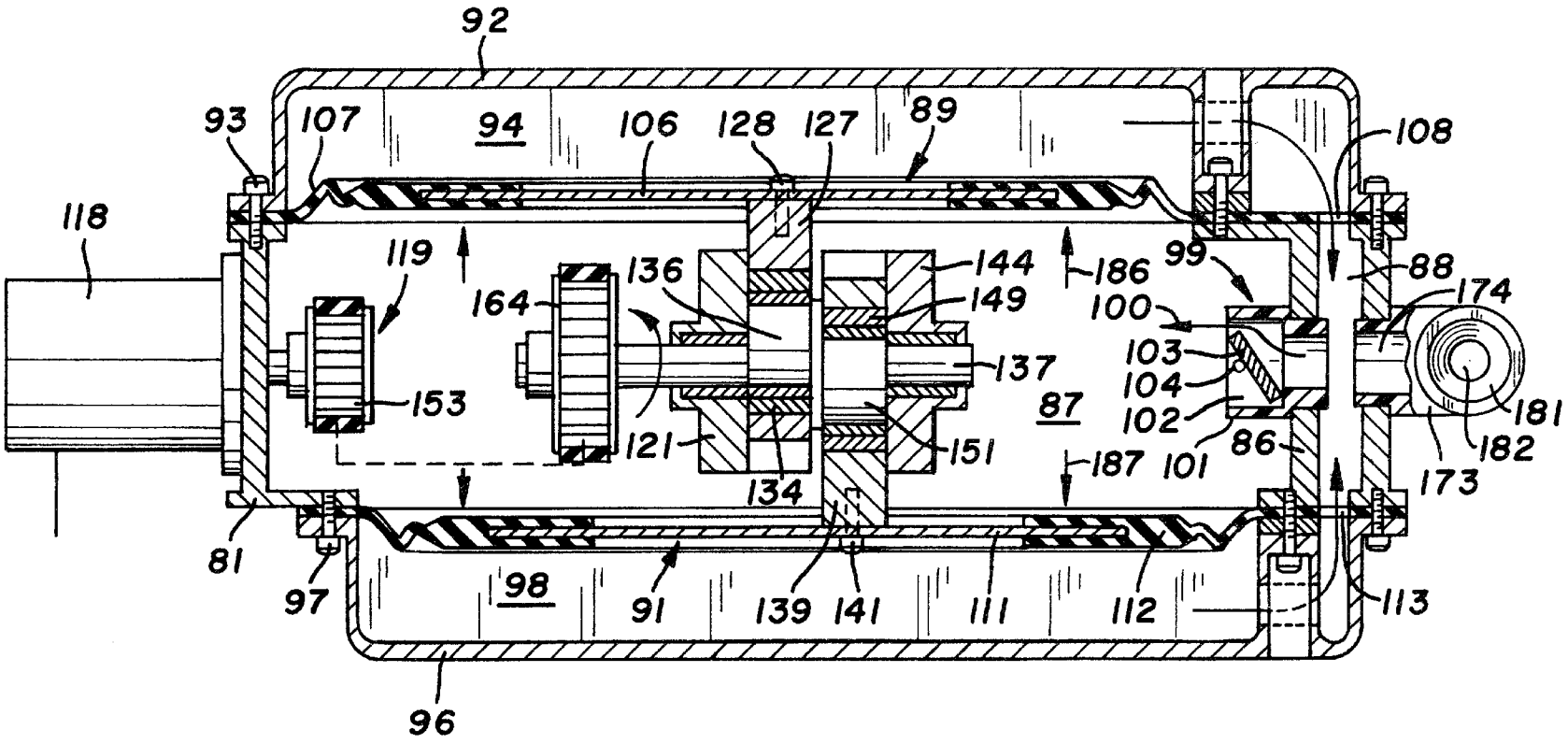
FIG. 14 is a sectional view similar to FIG. 8 showing the diaphragm assemblies in the air pumping mode.
Figure 15:
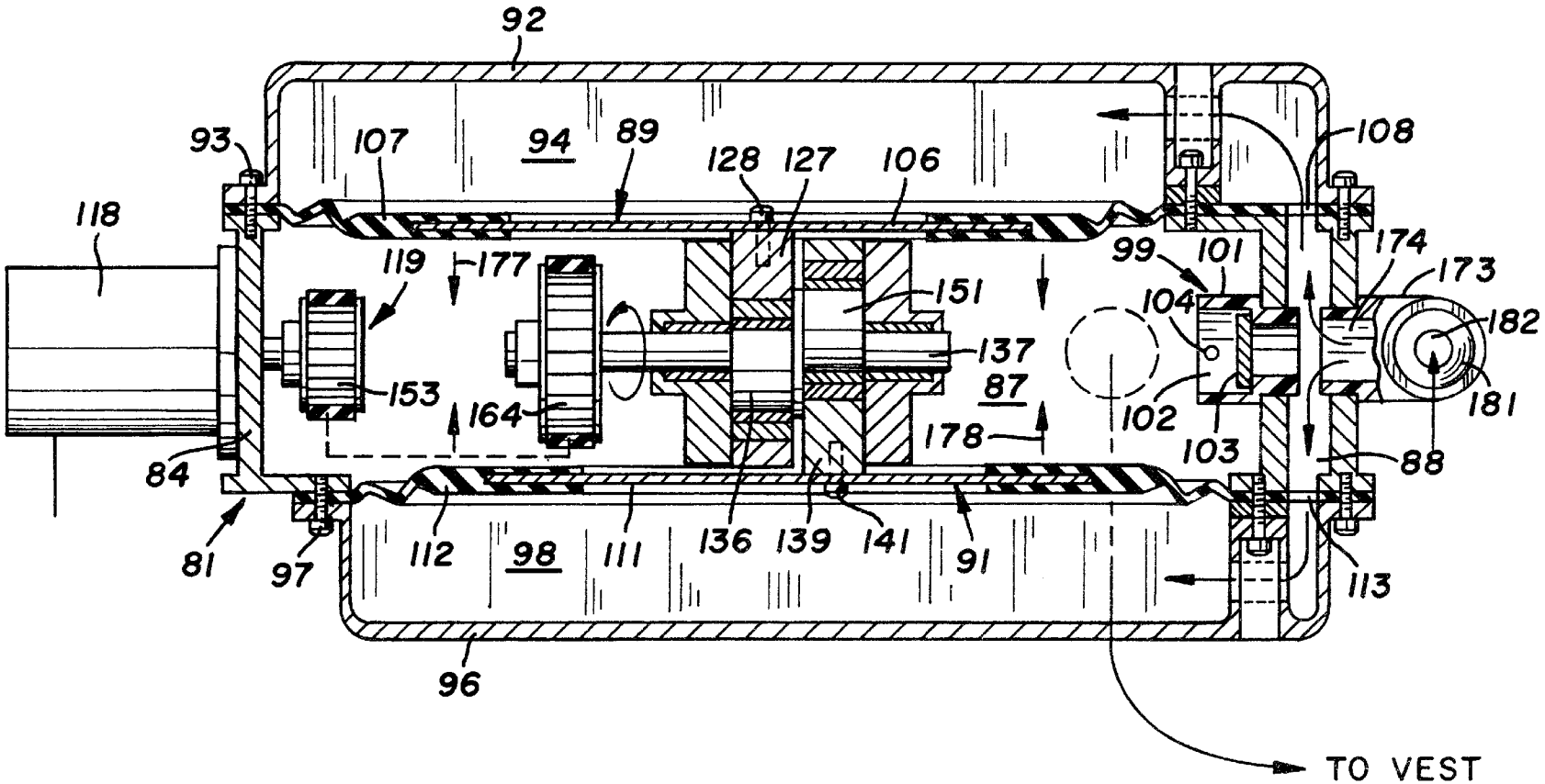
FIG. 15 is a sectional view similar to FIG. 8 showing the diaphragm assemblies in the air pulsing mode.

Diaphragms 89 and 91 are linearly moved in opposite lateral directions with linear motion transmission assemblies indicated generally at 116 and 117 driven with a variable speed dc electric motor 118. A belt and pulley power transmission 119 driveably connects motor 118 to motion transmission assemblies 116 and 117. As shown in FIGS. 11 and 13, motion transmission assembly 116 has a cross member 121 secured with fasteners 122 and 123 to casing side walls 82 and 83. Member 121 has a pair of parallel upright guide surfaces 124 and 126. A yoke 127 having opposite sides located in sliding engagement with guide surfaces 124 and 126 is secured to plate 106 with a pair of bolts 128 and 129. Bolts 128 and 129 extended through holes 131 and 132 in plate 107 prevent relative movement, including pivotal movement, between yoke 127 and plate 106. Yoke 127 has only linear reciprocating movement which prevents rocking and angular movement of diaphragm 89 during reciprocation thereof. As seen in FIG. 13, yoke 127 has a lateral opening or window 133 accommodating a slide block 134. Block 134 has a bore accommodating an eccentric 136 mounted on a shaft 137. Eccentric 136 is surrounded with a bearing 138 located in the bore of slide block 134. Yoke 127, slide block 134, eccentric 136 and shaft 137 are known as a scotch yoke power transmission assembly. A second scotch yoke power transmission assembly operatively connected to plate 111 of diaphragm 91 comprises a yoke 139 secured with a pair of bolts 140 and 141 to plate 111. Bolts 140 and 141 prevent relative movement, including pivotal movement, of yoke 139 relative to plate 111 whereby diaphragm 91 has only linear reciprocating movements. Yoke 139 has outside upright sides located in sliding engagement with upright guide surfaces 142 and 143 of a second cross member 144 which restricts movement of yoke 139 to reciprocating linear movement. Returning to FIG. 11, fasteners 146 and 147 are secured to cross member 144 to casing side walls 82 and 83. Second cross member 144 is located adjacent first cross member and rotably accommodates the outer end of shaft 137, as shown in FIGS. 8, 14 and 15. Yoke 139 has an opening or window 148 slidably accommodating a slide block 149 having a cylindrical bore for a bearing 152 and eccentric 151 secured to shaft 137. Eccentric 151 is located diametrically opposite eccentric 136, as shown in FIG. 14, so as to provide rotational balance to the scotch yoke power transmission assemblies.

Returning to FIG. 11, belt and pulley power transmission 119 has a small drive pulley 153 connected to drive shaft 154 of motor 118. A first endless belt 156 located about pulley 153 and a large pulley 157 secured to a jack shaft 158 transmits power to shaft 137 with a small pulley 162 on jack shaft 158 and an endless belt 163 coupling pulley 162 to a large pulley 164 secured to shaft 137. The small and large pulleys 153, 157 and 162, 164 provide power transmission 119 with speed reduction operation of shaft 137. As shown in FIGS. 6, 8 and 11, motion transmission assemblies 116 and 117, and belt and pulley power transmission 119 are located in pulsing chamber 87 and are surrounded by casing 81 and diaphragms 89 and 91. The isolation of the motion transmission assemblies 116 and 117 in chamber 87 reduces noise and protects these assemblies and belt and pulley power transmission 119 from external environmental contaminates.

Figure 4:
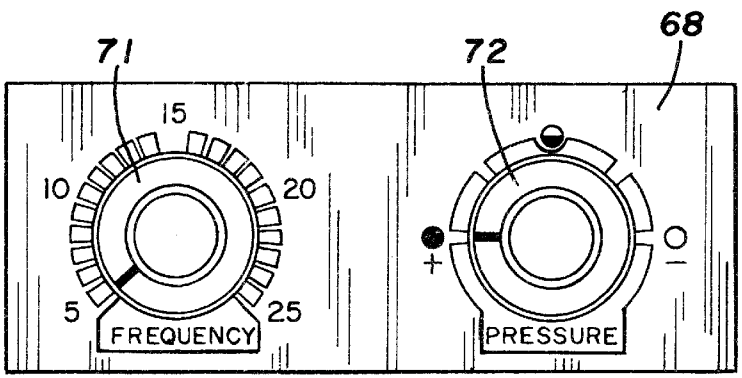
FIG. 4 is a top plan view of the frequency and air pressure control panel of the air pressure and pulse generator of FIG. 1.

The speed of dc motor 118 is regulated with a controller 166 connected to a manual rotatable knob 71 located in a user friendly position on control panel 68, as seen in FIGS. 1 and 4. Controller 166 is a commercial dc motor speed control unit operable to vary the voltage to dc motor 118 to control the operating speed of the motor. An example of controller 166 is controller Model XP05 of Minarik Corporation, Glendale, Calif. Other dc motor controllers can be used to control the speed of motor 118. As shown in FIG. 5, controller 166 is wired to timer 69 which has a switch 77 that is manually operable to connect controller 166 with a source of electric power to operate dc motor 118.

The pressure of the air in manifold chamber 88 is controlled with a variable orifice proportional free-flow valve 167 operable to restrict or choke the flow of air into and out of manifold chamber 88. Valve 167 has a body 168 having a passage 169. An air flow restnctor 171, shown as a threaded member, mounted on body 168 and extended into passage 169 regulates the flow of air through passage 169 into a tube 172. Other types of air flow restrictors, such as a rotatable grooved ball, can be used to regulate air flow through valve 167. The remote end of tube 172 is connected to an elbow 173 mounted on casing wall 85. Elbow 173 has a passage 174 open to manifold chamber 88 to allow air to flow into manifold chamber 88. A hole 175 in elbow 173 allows a limited amount of air to flow into and out of passage 174. A cylindrical porous member 176 mounted on body 168 filters and allows air to flow into and out of passage 169 and attenuates noise of air flowing through passage 169. Knob 72 is mechanically connected to restrictor 171 whereby rotation of knob 72 changes the restriction size of the air flow passage 169 and the rate of flow of air through passage 169. The rate of air flow through passage 169 controls the volume of air that flows into and out of manifold chamber 88. The volume of air in manifold chamber 88 and pumping chambers 94 and 98 is proportional to the pressure of the air in manifold chamber 88 generated by linear lateral movements of diaphragms 89 and 91, shown by arrows 177 and 178 in FIG. 6. The adjustment of valve 167 regulates the pressure of the air in manifold chamber 88, shown at 183 in FIG. 7, The air pressure in manifold chamber 88 follows a sine wave due to the harmonic linear reciprocating motion of diaphragms 89 and 91. The pressure of the air in pulsing chamber 87, shown at 184, has a sine wave opposite the sine wave of air pressure 183. When the air pressure in manifold chamber 88 exceeds the air pressure in pulsing chamber 87, air flows from manifold chamber 88, through one-way valve 99 into pulsing chamber 87 and from pulsing chamber into the air chamber 37 of air core 36.

As shown in FIGS. 5 and 6, an air flow control member 181 having a longitudinal passage 182 is mounted on the air inlet side of elbow 173. Member 181 modulates the air flow into and out of manifold chamber 88 to compensate for variations in air flow in tube 172, valve 167 and porous member 176.

In use, vest 11 is placed about the person's upper body or chest 14, as shown in FIGS. 1 and 2. Shoulder straps 43 and 44 connected to loop pads 48 and 49 vertically support vest 11 on person 13. The circumferential portion of vest 11 around body 14 is maintained in a comfortable snug fit with releasable connectors 52 and 54. Air pressure and pulse generator 12 is connected to the air core 36 within vest 11 with flexible tube 61. The remote end of tube 61 is connected to the air inlet end 60 of air manifold passage 38 of air core 36. Person 13 or the care person sets knobs 71 and 72 to select the pulsing frequency of the air pulses from 5 Hz to 25 Hz and the air pressure within air core 36. The duration of the pulsing session is selected by turning knob 76 of timer 79. The selected time of the session, for example 10 minutes, is displayed on time read out panel 74. Timer 69 is adjustable form 1 second to 30 minutes. The operation of air pressure and pulse generator 12 is commenced by pushing switch 77 on timer 69 to its ON position. Switch 77 also starts a count down of timer 69. When timer 69 has reached zero, the electric power to air pressure and pulse generator 12 is terminated. Switch 77 can be pushed during operation of air pressure and pulse generator 12 to stop the operation of the generator. As shown in FIG. 1, timer 69, frequency control knob 71, and pressure control knob 72 are located on front panel 68 for user friendly convenience and use. The rotational position of knob 71 regulates operation of motor controller 166 which controls the speed of dc motor 118.

As shown in FIGS. 6, 8, 11, 14 and 15, motor 118 through power transmission 119 rotates shaft 137 and turns eccentrics 136 and 151 about the axis of shaft 137. Eccentrics 136 and 151 laterally move slide blocks 134 and 149 relative to yokes 127 and 139 and linearly reciprocate yokes 127 and 139. Diaphragms 89 and 91 directed secured with bolts 128, 129, 140 and 141 to yokes 127 and 139 are linearly moved outwardly, shown by arrows 186 and 187 in FIGS. 12, 13 and 15, and inwardly, shown by arrows 117 and 178 in FIGS. 6 and 15. As shown in FIG. 15, when diaphragms 89 and 91 are linearly moved inwardly toward each other air flows from manifold chamber 88 into pumping chamber 94 and 98. A restricted amount of air flows through valve 167 and air flow control member 181 into manifold chamber 88. Knob 72 is adjusted to control air flow through valve 167 thereby control the amount and pressure of air in manifold chamber 88. Inward movement of diaphragms 89 and 91 increase the pressure of air in pulsing chamber 87 closing one-way valve 99 and transferring air under pressure through hose 61 to air core 36. Air core 36 expands inwardly to retain flexible liner 32 of vest 11 in firm engagement with the chest and back of person 13. Linear inward and outward movements of diaphragms 89 and 91 generate air pressure pulses in chamber 87 and air core 36 which applies repetitive forces, shown by arrows 18, to the chest and back of person 13 to simultaneously apply high frequency oscillation therapy to all lobes of the lungs and airway passages to enhance removal of mucus, secretions, and like materials therefrom.

Figure 12:
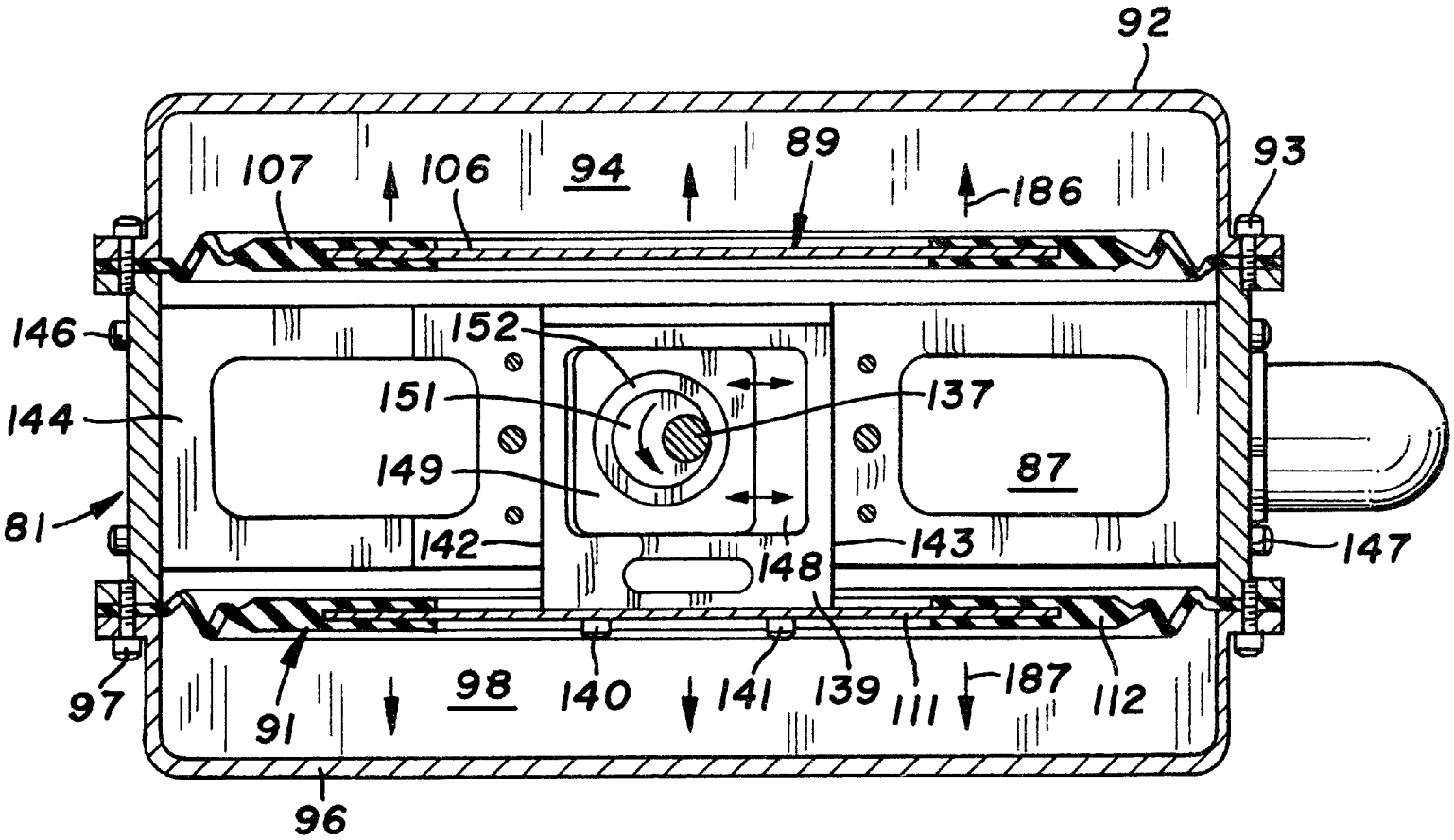
FIG. 12 is a sectional view taken along line 12—12 of FIG. 11.

As shown in FIGS. 12 to 14, outward linear movements of diaphragms 89 and 91 force air out of pumping chambers into manifold chamber 88 thereby increasing the pressure of the air in manifold chamber 88. When the pressure of the air in manifold chamber 88 exceeds the pressure of the air in pumping chamber 87, one-way valve 99 opens to allow air to flow from manifold chamber 88 into pulsing chamber 87, shown by arrow 100 in FIG. 14, thereby increasing the pressure of the air in pulsing chamber 87 and air core 36. One-way valve 99 closes in response to a drop in air pressure in manifold chamber 88 and prevents back flow of air from pulsing chamber 87 into manifold chamber 88. The size of passage 182 limits the amount of air that can flow into manifold chamber 88 thereby preventing excess pressure of air in manifold chamber 88 in the event that valve 167 becomes inoperative. Hole 175 in elbow 173 allows a limited amount of air to flow into and out of manifold chamber 88 to maintain a minimum pressure of air in pulsing chamber 87 and air core 36 in the event that valve 167 is closed.

Diaphragms 89 and 91 when linearly moved in opposite directions by the linear motion transmission assemblies 116 and 117 repetitively perform the dual functions of establishing air pressure and pulsing the air in pulsing chamber 87 and air core 36. The frequency of air pulses is controlled between 5 and 25 cycles per second by varying the speed of dc motor 118. Motor controller 166 is adjusted with manual control knob 71 used by person 13 or the caregiver to alter the speed of motor 118 to change the pulse frequency of the air pulses in pulsing chamber 87 and air core 36. The valve 167 restricts the flow of air into and out of manifold chamber 88 to regulate the pressure of the air in manifold chamber 88 which is transferred through check valve 99 to pulsing chamber 87 responsive to the linear movements of diaphragms 89 and 91.

Hose 61 directs air under pressure and air pulses to air manifold passage 38 in the bottom of air core 36. An elongated coiled spring 41 within air core 36 maintains passage 38 open to allow air to flow through openings 39 upwardly into air chamber 37. The air pulsing in chamber 37 applies inwardly and upwardly directed pulsing forces to the person's rib cage 27 which transfers the pulsing forces to the lungs and airway passages. The outer cover 31 of vest 11 being non-elastic material limits outward expansion of air core 36. Outer cover 31 extended around the lower portion of air core 36 containing coil spring 36 limits inward pressure of air core 36 on the person's abdomen. The frequency of the pulses range from 5 to 25 cycles per second. The pulse forces loosen mucus and secretions from the lungs and airway passages toward the mouth where they can be removed by normal coughing. Air core 36 has a plurality of small openings or holes 42 which allow limited amounts of air to flow out of chamber 37 into vest 11. The air ventilates and cools the upper body 14 surrounded by vest 11 and deflates air core 36 when air pressure and pulse generator 12 is turned OFF.

The body pulsating apparatus and method has been described as applicable to persons having cystic fibrosis. The body pulsating apparatus and method is applicable to bronchiectasis persons, post-surgical atelectasis, and stage neuromuscular disease, ventilator dependent patients experiencing frequent pneumonias, and persons with reduced mobility or poor tolerance of Trendelenburg positioning. Person with secretion clearance problems arising from a broad range of diseases and conditions are candidates for therapy using the body pulsating apparatus and method of the invention.

The present disclosure is a preferred embodiment of the body pulsating apparatus and method. It is understood that the body pulsating apparatus is not to be limited to the specific materials, constructions and arrangements shown and described. It is understood that changes in parts, materials, arrangement and locations of structures may be made without departing from the invention.

What is claimed is:

1. An apparatus for generating air pressure and air pressure pulses in an enclosure comprising: a casing surrounding an air pulsing chamber, means connected to the casing adapted to carry air and air pressure pulses from the air pulsing chamber to the enclosure, said casing having a first opening and a second opening opposite the first opening, a first diaphragm extended across the first opening of the casing, a first cover located over and spaced from the first diaphragm having a first pumping chamber in communication with the first diaphragm, first means securing the first cover and first diaphragm to the casing, a second diaphragm extended across the second opening of the casing, a second cover located over and spaced from the second diaphragm having a second pumping chamber in communication with the second diaphragm, second means securing the second cover and second diaphragm to the casing, said casing having an internal wall separating the pulsing chamber from a manifold chamber, said manifold chamber being in air communication with said first and second pumping chambers, a one-way valve mounted on the internal wall operable to allow air to flow from the manifold chamber into the pulsing chamber and prevent the flow of air from the pulsing chamber back to the manifold chamber, air flow regulating means for restricting the flow of air into and out of the manifold chamber to control the pressure of the air in the manifold chamber, said air flow regulating means including an adjustable member operable to adjust the rate of the flow of air into and out of the manifold chamber thereby regulating the pressure of the air in the manifold chamber, a first motion transmission assembly connected to the first diaphragm operable to linearly move the first diaphragm relative to the pulsing and first pumping chambers, a second motion transmission assembly connected to the second diaphragm operable to linearly move the second diaphragm relative to the pulsing and second pumping chambers, a variable speed motor, power transmission means connecting the motor to the first and second motion transmission assemblies whereby on operation of the motor the first and second motion transmission assemblies linearly reciprocate the first and second diaphragms to pulse air in the pulsing chamber and cause air to flow from the manifold chamber into and out of the first and second pumping chambers and increase the pressure of the air in the manifold chamber, said one-way valve allowing air to flow from the manifold chamber into the pulsing chamber when the pressure of the air in the manifold chamber is greater than the pressure of the air in the pulsing chamber, and a controller connected to the motor operable to vary the speed of the motor to regulate the reciprocating movements of the diaphragms thereby regulating the frequency of the air pulses in the pulsing chamber and enclosure.

2. The apparatus of claim 1 including: a timer connected to the controller for controlling the duration of electric power to said controller to regulate the duration of operation of the motor, said timer including an on-off switch operable to start the timer and terminate electric power to the controller thereby stopping the operation of the motor.

3. The apparatus of claim 1 wherein: the first and second diaphragms each has a rigid plate and a flexible member surrounding and secured to the plate, said flexible member being secured to said casing with one of the first and second means, and fastener means directly securing each plate to a motion transmission assembly.

4. The apparatus of claim 3 wherein: each flexible member has a continuous accordion fold section surrounding the plate to minimize stretching of the flexible member during linear reciprocating movements of the diaphragms.

5. The apparatus of claim 1 wherein: the adjustable member of the air flow regulating means comprises a valve having a passage to allow air to flow through the valve, an air flow restrictor located in the passage to regulate the flow of air through said passage, and a control connected to the restrictor to adjust the position of the restrictor relative to the passage thereby adjust the flow of air through said passage.

6. The apparatus of claim 5 wherein: the control includes a manual operated member useable by a person to adjust the position of the restrictor relative to the passage thereby adjusting the pressure of the air in the manifold chamber.

7. The apparatus of claim 5 including: a porous member connected to the valve to allow air to flow through the porous member into the passage of the valve.

8. The apparatus of claim 1 wherein: the air flow regulating means includes an air flow modulator located downstream from the adjustable member, said modulator having a passage allowing air to flow into and out of the manifold chamber.

9. The apparatus of claim 1 including: a member mounted on the casing having a passage open to the manifold chamber and air flow regulating means, an air flow modulator mounted on the member having a passage allowing air to flow from the air flow regulating means into and out of the manifold chamber.

10. The apparatus of claim 9 wherein: said member has a hole allowing limited air flow into and out of the manifold chamber.

11. The apparatus of claim 1 wherein: said one-way valve has a housing mounted on the internal wall, said housing having a passage open to the pulsating chamber and manifold chamber, and a valving member located in said passage operable to allow air to flow from the manifold chamber into the pulsing chamber and prevent the flow of air from the pulsing chamber back to the manifold chamber.

12. The apparatus of claim 1 wherein: the first and second motion transmission assembly each has a cross member located in the pulsing chamber secured to the casing, said cross member having spaced parallel guide surfaces extended normal to the diaphragms, a yoke located in slidable engagement with said guide surfaces and movable in opposite directions normal to said diaphragms, fastener means directly securing the yoke to the diaphragm, said yoke having an opening, a slide block located in said opening for movement normal to the movement of the yoke, said block having a cylindrical bore, an eccentric located in said bore, a shaft secured to the eccentric drivably connected to power transmission means whereby on operation of the motor the shaft is rotated to turn the eccentric and linearly move the yoke in opposite linear directions and reciprocate the diaphragms in opposite linear directions.

13. An apparatus for generating air pressure and air pressure pulses in an air core having a flexible wall and an internal air chamber surrounding the upper body of a person to apply repetitive pressure pulses to said upper body of the person comprising: a casing surrounding an air pulsing chamber, means connected to the air pulsing chamber for carrying air and air pressure pulses from the air pulsing chamber to the internal chamber of the air core whereby the air pressure pulses apply repetitive pressure pulse forces to the upper body of the person, said casing having a first opening and a second opening opposite the first opening, a first diaphragm extended across the first opening of the casing, a first cover located over and spaced from the first diaphragm having a first pumping chamber in communication with the first diaphragm, first means securing the first cover and first diaphragm to the casing, a second diaphragm extended across the second opening of the casing, a second cover located over and spaced from the second diaphragm having a second pumping chamber in communication with the second diaphragm, second means securing the second cover and second diaphragm to the casing, said casing having an internal wall separating the pulsing chamber from a manifold chamber, said manifold chamber being in air communication with said first and second pumping chambers, a one-way valve mounted on the internal wall operable to allow air to flow from the manifold chamber into the pulsing chamber and prevent the flow of air from the pulsing chamber back to the manifold chamber, air flow regulating means for restricting the flow of air into and out of the manifold chamber to control the pressure of the air in the manifold chamber, said air flow regulating means including an adjustable member operable to adjust the rate of the flow of air into and out of the manifold chamber thereby regulating the pressure of the air in the manifold chamber, a first motion transmission assembly connected to the first diaphragm operable to linearly move the first diaphragm relative to the pulsing and first pumping chambers, a second motion transmission assembly connected to the second diaphragm operable to linearly move the second diaphragm relative to the pulsing and second pumping chambers, a variable speed motor, power transmission means connecting the motor to the first and second motion transmission assemblies whereby on operation of the motor the first and second motion transmission assemblies linearly reciprocate the first and second diaphragms to pulse air in the pulsing chamber and cause air to flow from the manifold chamber into and out of the first and second pumping chambers and increase the pressure of the air in the manifold chamber, said one-way valve allowing air to flow from the manifold chamber into the pulsing chamber and from the pulsing chamber into the air chamber of the air core when the pressure of the air in the manifold chamber is greater than the pressure of the air in the pulsing chamber, and a controller connected to the motor operable to vary the speed of the motor to regulate the reciprocating movements of the diaphragms thereby regulating the frequency of the air pulses in the pulsing chamber and air chamber of the air core thereby regulating the frequency of the repetitive pressure pulse forces applied to the upper body of the person.

14. The apparatus of claim 13 including: a timer connected to the controller for controlling the duration of electric power to said controller to regulate the duration of operation of the motor, said timer including an on-off switch operable to start the time and terminate electric power to the controller thereby stopping operation of the motor.

15. The apparatus of claim 13 wherein: the first and second diaphragms each has a rigid plate and a flexible member surrounding and secured to the plate, said flexible member being secured to said casing with one of the first and second means, and fastener means directly securing each plate to a motion transmission assembly.

16. The apparatus of claim 15 wherein: each flexible member has a continuous accordion fold section surrounding the plate to minimize stretching of the flexible member during linear reciprocating movements of the diaphragms.

17. The apparatus of claim 13 wherein: the adjustable member of the air flow regulating means comprises a valve having a passage to allow air to flow through the valve, an air flow restrictor located in the passage to regulate the flow of air through said passage, and a control connected to the restrictor to adjust the position of the restrictor relative to the passage thereby adjust the flow of air through said passage.

18. The apparatus of claim 17 wherein: the control includes a manual operated member useable by a person to adjust the position of the restrictor relative to the passage thereby adjusting the pressure of the air in the manifold chamber.

19. The apparatus of claim 17 including: a porous member connected to the valve to allow air to flow through the porous member into the passage of the valve.

20. The apparatus of claim 13 wherein: the air flow regulating means includes an air flow modulator located downstream from the adjustable member, said modulator having a passage allowing air to flow into and out of the manifold chamber.

21. The apparatus of claim 13 including: a member mounted on the casing having a passage open to the manifold chamber and air flow regulating means, an air flow modulator mounted on the member having a passage allowing air to flow from the air flow regulating means into and out of the manifold chamber.

22. The apparatus of claim 21 wherein: said member has a hole allowing limited air flow into and out of the manifold chamber.

23. The apparatus of claim 13 wherein: said one-way valve has a housing mounted on the internal wall, said housing having a passage open to the pulsating chamber and manifold chamber, and a valving member located in said passage operable to allow air to flow from the manifold chamber into the pulsing chamber and prevent the flow of air from the pulsing chamber back to the manifold chamber.

24. The apparatus of claim 13 wherein: the first and second motion transmission assembly each has a cross member located in the pulsing chamber secured to the casing, said cross member having spaced parallel guide surfaces extended normal to the diaphragms, a yoke located in slidable engagement with said guide surfaces and movable in opposite directions normal to said diaphragms, fastener means directly securing the yoke to the diaphragm, said yoke having an opening, a slide block located in said opening for movement normal to the movement of the yoke, said block having a cylindrical bore, an eccentric located in said bore, a shaft secured to the eccentric drivably connected to power transmission means whereby on operation of the motor the shaft is rotated to turn the eccentric and linearly move the yoke in opposite linear directions and reciprocate the diaphragms in opposite linear directions.

25. An apparatus for generating air pressure and air pressure pulses in an enclosure comprising: a casing having an air pulsing chamber and an opening, a diaphragm mounted on the casing closing the opening, means having a passage adapted to connect the casing to the enclosure for carrying air and air pressure pulses to the enclosure, a cover located over and spaced from the diaphragm having a pumping chamber, means securing the cover and diaphragm to the casing, said casing having an internal wall separating the pulsing chamber from a manifold chamber, said manifold chamber being in air communication with said pumping chamber, at least one valve mounted on the internal wall operable to allow air to flow from the manifold chamber into the pulsing chamber and prevent air to flow back from the pulsing chamber into the manifold chamber, air flow regulating means for restricting the flow of air into and out of the manifold chamber to control the pressure of the air in the manifold chamber, drive means connected to the diaphragm operable to reciprocate the diaphragm relative to the pumping chamber, a variable speed motor connected to the drive means whereby on operation of the motor the drive means reciprocates the diaphragm to pulse air in the pulsing chamber and cause air to flow from the manifold chamber into and out of the pumping chamber and increase the pressure of the air in the manifold chamber, said valve allowing air to flow from the manifold chamber into the pulsing chamber when the pressure of the air in the manifold chamber is greater than the pressure of the air in the pulsing chamber, and a controller connected to the motor operable to vary the speed of the motor to regulate the reciprocating movement of the diaphragm thereby regulating the frequency of the air pulses in the pulsing chamber and enclosure.

26. The apparatus of claim 25 including: a timer connected to the controller for controlling the duration of electric power to said controller to regulate the duration of operation of the motor, said timer including an on-off switch operable to start the timer and terminate electric power to the controller thereby stopping the operation of the motor.

27. The apparatus of claim 25 wherein: the diaphragm has a rigid plate and a flexible member surrounding and secured to the plate, said flexible member being secured to said casing with the means securing the cover and diaphragm to the casing, and fastener means directly securing the plate to said drive means.

28. The apparatus of claim 27 wherein: the flexible member has a continuous accordion fold section surrounding the plate to minimize stretching of the flexible member during reciprocating movements of the diaphragm.

29. The apparatus of claim 25 wherein: the air flow regulating means includes a valve having a passage to allow air to flow through the valve, an air flow restrictor located in the passage to regulate the flow of air through said passage, and a control connected to the restrictor to adjust the position of the restrictor relative to the passage thereby adjust the flow of air through said passage.

30. The apparatus of claim 29 wherein: the control includes a manual operated member useable by a person to adjust the position of the restrictor relative to the passage thereby adjusting the pressure of the air in the manifold chamber.

31. The apparatus of claim 29 including: a porous member connected to the valve to allow air to flow through the porous member into the passage of the valve.

32. The apparatus of claim 25 wherein: the air flow regulating means includes an air flow modulator located downstream from the adjustable member, said modulator having a passage allowing air to flow into and out of the manifold chamber.

33. The apparatus of claim 25 including: a member mounted on the casing having a passage open to the manifold chamber and air flow regulating means, an air flow modulator mounted on the member having a passage allowing air to flow from the air flow regulating means into and out of the manifold chamber.

34. The apparatus of claim 33 wherein: said member has a hole allowing limited air flow into and out of the manifold chamber.

35. The apparatus of claim 25 wherein: said one-way valve has a housing mounted on the internal wall, said housing having a passage open to the pulsating chamber and manifold chamber, and a valving member located in said passage operable to allow air to flow from the manifold chamber into the pulsing chamber and prevent the flow of air from the pulsing chamber back to the manifold chamber.

36. The apparatus of claim 25 wherein: the drive means has a cross member located in the pulsing chamber secured to the casing, said cross member having spaced parallel guide surfaces extended normal to the diaphragm, a yoke located in slidable engagement with said guide surfaces and movable in opposite directions normal to said diaphragm, fastener means directly securing the yoke to the diaphragm, said yoke having an opening, a slide block located in said opening for movement normal to the movement of the yoke, said block having a cylindrical bore, an eccentric located in said bore, a shaft secured to the eccentric drivably connected to power transmission means whereby on operation of the motor the shaft is rotated to turn the eccentric and linearly move the yoke in opposite linear directions and reciprocate the diaphragm in opposite linear directions.

37. An apparatus for generating air pressure and air pressure pulses in an air core having a flexible wall and an internal air chamber surrounding the upper body of a person to apply repetitive pressure pulses to said upper body of the person comprising: a casing having an air pulsing chamber and an opening, a diaphragm mounted on the casing closing the opening, means having a passage adapted to connect the casing to the air chamber of the air core for carrying air and air pressure pulses to the air chamber of the air core to apply repetitive pressure pulses to the upper body of the person, a cover located over and spaced from the diaphragm having a pumping chamber, means securing the cover and diaphragm to the casing, said casing having an internal wall separating the pulsing chamber from a manifold chamber, said manifold chamber being in air communication with said pumping chamber, at least one valve mounted on the internal wall operable to allow air to flow from the manifold chamber into the pulsing chamber and prevent air to flow back from the pulsing chamber into the manifold chamber, air flow regulating means for restricting the flow of air into and out of the manifold chamber to control the pressure of the air in the manifold chamber, drive means connected to the diaphragm operable to reciprocate the diaphragm relative to the pumping and pulsing chamber, a variable speed motor connected to the drive means whereby on operation of the motor the drive means reciprocates the diaphragm to pulse air in the pulsing chamber and air chamber of the air core and cause air to flow from the manifold chamber into and out of the pumping chamber and increase the pressure of the air in the manifold chamber, said valve allowing air to flow from the manifold chamber into the pulsing chamber and air chamber of the air core when the pressure of the air in the manifold chamber is greater than the pressure of the air in the pulsing chamber, and a controller connected to the motor operable to vary the speed of the motor to regulate the reciprocating movement of the diaphragm thereby regulating the frequency of the air pulses in the pulsing chamber and air chamber of the air core thereby regulating the frequency of the pressure pulses applied to the upper body of the person.

38. The apparatus of claim 37 wherein: the diaphragm has a rigid plate and a flexible member surrounding and secured to the plate, said flexible member being secured to said casing with the means securing the cover and diaphragm to the casing, and fastener means directly securing the plate to said drive means.

39. The apparatus of claim 38 wherein: the flexible member has a continuous accordion fold section surrounding the plate to minimize stretching of the flexible member during reciprocating movements of the diaphragm.

40. The apparatus of claim 37 wherein: the air flow regulating means includes a valve having a passage to allow air to flow through the valve, an air flow restrictor located in the passage to regulate the flow of air through said passage, and a control connected to the restrictor to adjust the position of the restrictor relative to the passage thereby adjust the flow of air through said passage.

41. The apparatus of claim 40 wherein: the control includes a manual operated member useable by a person to adjust the position of the restrictor relative to the passage thereby adjusting the pressure of the air in the manifold chamber.

42. The apparatus of claim 40 including: a porous member connected to the valve to allow air to flow through the porous member into the passage of the valve.

43. The apparatus of claim 37 wherein: the air flow regulating means includes an air flow modulator located downstream from the adjustable member, said modulator having a passage allowing air to flow into and out of the manifold chamber.

44. The apparatus of claim 37 including: a member mounted on the casing having a passage open to the manifold chamber and air flow regulating means, an air flow modulator mounted on the member having a passage allowing air to flow from the air flow regulating means into and out of the manifold chamber.

45. The apparatus of claim 44 wherein: said member has a hole allowing limited air flow into and out of the manifold chamber.

46. The apparatus of claim 37 wherein: said one-way valve has a housing mounted on the internal wall, said housing having a passage open to the pulsating chamber and manifold chamber, and a valving member located in said passage operable to allow air to flow from the manifold chamber into the pulsing chamber and prevent the flow of air from the pulsing chamber back to the manifold chamber.

47. The apparatus of claim 37 wherein: the drive means has a cross member located in the pulsing chamber secured to the casing, said cross member having spaced parallel guide surfaces extended normal to the diaphragm, a yoke located in slidable engagement with said guide surfaces and movable in opposite directions normal to said diaphragm, fastener means directly securing the yoke to the diaphragm, said yoke having an opening, a slide block located in said opening for movement normal to the movement of the yoke, said block having a cylindrical bore, an eccentric located in said bore, a shaft secured to the eccentric drivably connected to power transmission means whereby on operation of the motor the shaft is rotated to turn the eccentric and linearly move the yoke in opposite linear directions and reciprocate the diaphragm in opposite linear directions.

48. The apparatus of claim 37 including: a timer connected to the controller for controlling the duration of electric power to said controller to regulate the duration of operation of the motor, said timer including an on-off switch operable to start the timer and terminate electric power to the controller thereby stopping the operation of the motor.

49. A method of generating air pressure and air pressure pulses with first and second diaphragms separating and air pulsing chamber from first and second air pumping chambers and a wall supporting a one-way valve separating the pulsing chamber from an air manifold chamber comprising: reciprocating the first and second diaphragms toward each other and away from each other relative to the pulsing chamber and first and second pumping chambers to pulse air in the pulsing chamber and cause air to flow into the pumping chambers when the first and second diaphragms are moved toward each other and cause air to flow out of the pumping chambers into the manifold chamber when the diaphragms are moved away from each other, allowing air and air pressure pulses to flow from the pulsing chamber when the diaphragms are moved toward each other, restricting the flow of air into and out of the manifold chamber during reciprocation of the first and second diaphragms to regulate the pressure of the air in the manifold chamber, allowing air to flow through the one-way valve from the manifold chamber into the pulsing chamber when the pressure of the air in the manifold chamber is greater than the pressure of the air in the pulsing chamber, and regulating the rate of reciprocation of the diaphragms to regulate the frequency of the air pressure pulses in the pulsing chamber.

50. The method of claim 49 including: adjusting the restriction of the flow of air into and out of the manifold chamber to change the pressure of the air in the manifold chamber.

51. The method of claim 49 wherein: the regulation of the rate of reciprocation of the first and second diaphragms is achieved by changing the speed of reciprocation of the first and second diaphragms.

52. The method of claim 49 including: modulating the flow of air into the manifold chamber after the restriction of the flow of air into and out of the manifold chamber.

53. A method of applying pressure pulsing forces to the thorax of a person with a flexible air core having an internal air chamber coupled to an air pump and pulsator having a diaphragm separating an air pulsing chamber from an air pumping chamber and a wall having a one-way valve separating the pulsing chamber from an air manifold chamber comprising: surrounding a person's thorax with the flexible air core, reciprocating the diaphragm relative to the pulsing chamber and pumping chamber to pulse air in the pulsing chamber and cause air to flow from the manifold chamber into and out of the pumping chamber, transferring air and air pressure pulses from the pulsing chamber to the air chamber of the air core, said air pressure pulses applying inward pressure forces to the thorax of the person, restricting the flow of air into and out of the manifold chamber during reciprocation of the diaphragm to regulate the pressure of the air in the manifold chamber, allowing air to flow through the one-way valve from the manifold chamber into the pulsing chamber when the pressure of the air in the manifold chamber is greater than the pressure of the air in the pulsing chamber thereby increasing the pressure of the air in the pulsing chamber and air chamber of the air core and the pressure of the air core on the thorax of the person, and regulating the rate of reciprocation of the diaphragm to regulate the frequency of the air pulses in the pulsing chamber and air chamber of the air core thereby regulating the frequency of the pressure pulsing forces applied to the thorax of the person.

54. The method of claim 53 wherein: the diaphragm is linearly reciprocated by moving the diaphragm into the pulsing chamber to pulse air in the pulsing chamber and draw air into the manifold chamber and pumping chamber and moving the diaphragm into the pumping chamber to force air out of the pumping chamber into the manifold chamber to increase the pressure of the air in the manifold chamber and cause air to flow from the manifold chamber through the one-way valve into the pumping chamber when the pressure of the air in the manifold chamber is greater than the pressure of the air in the pulsing chamber.

55. The method of claim 53 including: adjusting the restriction of the flow of air into and out of the manifold chamber to change the pressure of the air in the manifold chamber.

56. The method of claim 53 wherein: the regulation of the rate of reciprocation of the diaphragm is achieved by changing the speed of reciprocation of the diaphragm.

57. The method of claim 53 including: modulating the flow of air into the manifold chamber after the restriction of the flow of air into and out of the manifold chamber.

58. The method of claim 53 including: allowing leakage of air from the air chamber through the air core during pulsing of air in the air chamber.

59. A method of applying pressure pulsing forces to the thorax of a person with a flexible air core having an internal air chamber and an air receiving passage located below and in air communication with the internal chamber connected with a hose to an air pump and pulsator having first and second diaphragms separating an air pulsing chamber from first and second air pumping chambers and a wall supporting a one-way valve separating the pulsing chamber from an air manifold chamber comprising: surrounding a person's thorax with the flexible air core, reciprocating the first and second diaphragms toward each other and away from each other relative to the pulsing chamber and first and second pumping chambers to pulse air in the pulsing chamber and the air chamber of the air core and cause air to flow into the first and second pumping chambers when the first and second diaphragms are moved toward each other and cause air to flow out of the first and second pumping chambers into the manifold chamber when the first and second diaphragms are moved away from each other, restricting the flow of air into and out of the manifold chamber during reciprocation of the first and second diaphragms to regulate the pressure of the air in the manifold chamber, allowing air to flow through the one-way valve from the manifold chamber into the pulsing chamber when the pressure of the air in the manifold chamber is greater than the pressure of the air in the pulsing chamber thereby increasing the pressure of the air in the pulsing chamber and air chamber of the air core and the pressure of the air core on the thorax of the person, and regulating the rate of reciprocation of the first and second diaphragms to regulate the frequency of the air pulses in the pulsing chamber and air chamber of the air core thereby regulating the frequency of the pressure pulses applied to the thorax of the person.

60. The method of claim 59 including: adjusting the restriction of the flow of air into and out of the manifold chamber to change the pressure of the air in the manifold chamber.

61. The method of claim 59 wherein: the regulation of the rate of reciprocation of the first and second diaphragms is achieved by changing the speed of reciprocation of the first and second diaphragms.

62. The method of claim 59 including: modulating the flow of air into the manifold chamber after the restriction of the flow of air into and out of the manifold chamber.

63. The method of claim 53 including: directing air and air pressure pulses into the air receiving passage of the air core, and directing air and air pressure upwardly from the air receiving passage into the air chamber of the air core.

64. The method of claim 53 including: allowing leakage of air from the air chamber through the air core during the pulsing of air in the air chamber.

65. A method of generating air pressure and air pressure pulses with a diaphragm separating an air pulsing chamber from an air pumping chamber and a wall having a one-way valve separating the pulsing chamber from an air manifold chamber comprising: reciprocating the diaphragm relative to the pulsing chamber and pumping chamber to pulse air in the pulsing chamber and cause air to flow from the manifold chamber into and out of the pumping chamber, allowing air and air pressure pulses to flow from the pulsing chamber, restricting the flow of air into and out of the manifold chamber during reciprocation of the diaphragm to regulate the pressure of the air in the manifold chamber, allowing air to flow through the one-way valve from the manifold chamber into the pulsing chamber when the pressure of the air in the manifold chamber is greater than the pressure of the air in the pulsing chamber, and regulating the rate of reciprocation of the diaphragm to regulate the frequency of the air pulses in the pulsing chamber.

66. The method of claim 65 wherein: the diaphragm is linearly reciprocated by moving the diaphragm into the pulsing chamber to pulse air in the pulsing chamber and draw air into the manifold chamber and pumping chamber and moving the diaphragm into the pumping chamber to force air out of the pumping chamber into the manifold chamber to increase the pressure of the air in the manifold chamber and cause air to flow from the manifold chamber through the one-way valve into the pumping chamber when the pressure of the air in the manifold chamber is greater than the pressure of the air in the pulsing chamber.

67. The method of claim 65 including: adjusting the restriction of the flow of air into and out of the manifold chamber to change the pressure of the air in the manifold chamber.

68. The method of claim 65 wherein: the regulation of the rate of reciprocation of the diaphragm is achieved by changing the speed of reciprocation of the diaphragm.

69. The method of claim 65 including: modulating the flow of air into the manifold chamber after the restriction of the flow of air into and out of the manifold chamber.

* * * * *